US005257663A

United States Patent [19]

Pringle et al.

[11] Patent Number: 5,257,663

[45] Date of Patent: Nov. 2, 1993

[54] ELECTRICALLY OPERATED SAFETY RELEASE JOINT

[75] Inventors: Ronald E. Pringle, Houston; Arthur J. Morris, Magnolia, both of Tex.

[73] Assignee: Camco Internationa Inc., Houston, Tex.

[21] Appl. No.: 953,404

[22] Filed: Sep. 29, 1992

Related U.S. Application Data

[62] Division of Ser. No. 772,828, Oct. 7, 1991.

[51] Int. Cl.[5] ..... E21B 17/06

[52] U.S. Cl. ..... 166/66.4; 166/65.1; 166/242; 166/377; 285/2; 285/23

[58] Field of Search ..... 166/65.1, 242, 377, 166/382, 66, 66.4; 285/1, 2, 3, 23, 315, 920, 922

[56] References Cited

U.S. PATENT DOCUMENTS

| | | | |
|---|---|---|---|
| 2,532,686 | 12/1950 | Ware | 285/2 |
| 2,937,854 | 5/1960 | Kinley et al. | 285/3 |
| 3,208,527 | 9/1965 | Bayless | 166/66.4 X |
| 3,456,723 | 7/1969 | Current et al. | 166/120 |
| 4,275,786 | 6/1981 | Lee | 166/66 |
| 4,285,533 | 8/1981 | Silberman et al. | 166/242 X |
| 4,364,587 | 12/1982 | Samford | 166/65.1 X |
| 4,402,533 | 9/1983 | Ortloff | 285/920 X |
| 4,445,572 | 5/1984 | Fineberg et al. | 166/242 X |
| 4,577,534 | 1/1986 | Going, III | 166/66.4 |
| 4,579,177 | 4/1986 | Gong, III | 166/332 |
| 4,649,993 | 3/1987 | Going, III | 166/65.1 |
| 4,997,043 | 3/1991 | Pringle | 166/38.2 |

*Primary Examiner*—Hoang C. Dang
*Attorney, Agent, or Firm*—Fulbright & Jaworski

[57] ABSTRACT

A method and apparatus of electrically and sequentially completing an oil and/or gas well through a tubing production string in a well casing. The operation includes electrically and sequentially actuating downhole equipment such as well packers, a safety joint, well annulus safety valve, solenoid actuated tubing safety valve, blanking block valve, circulating sleeve, and receiving electrical feedback from the equipment determining the position of the downhole equipment.

1 Claim, 23 Drawing Sheets

FIG.4E
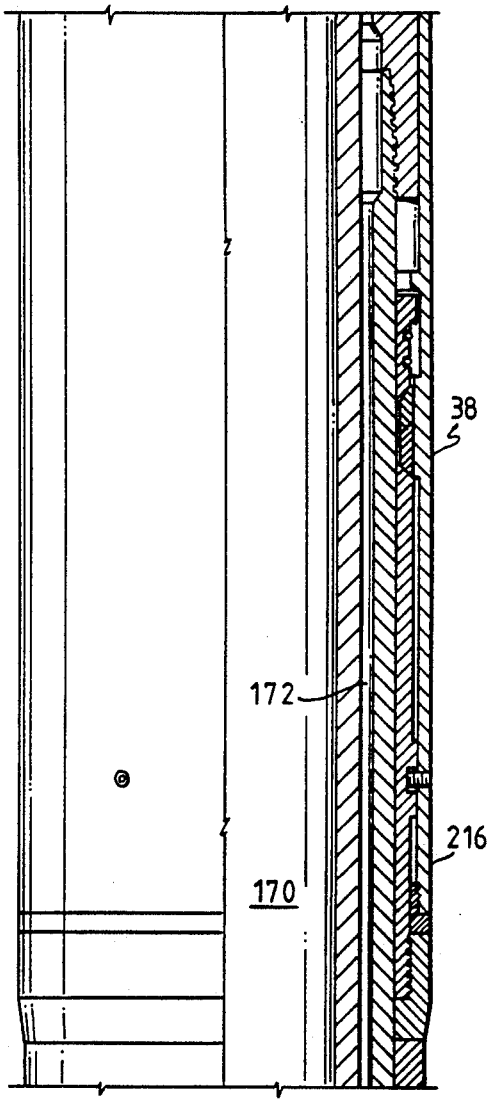
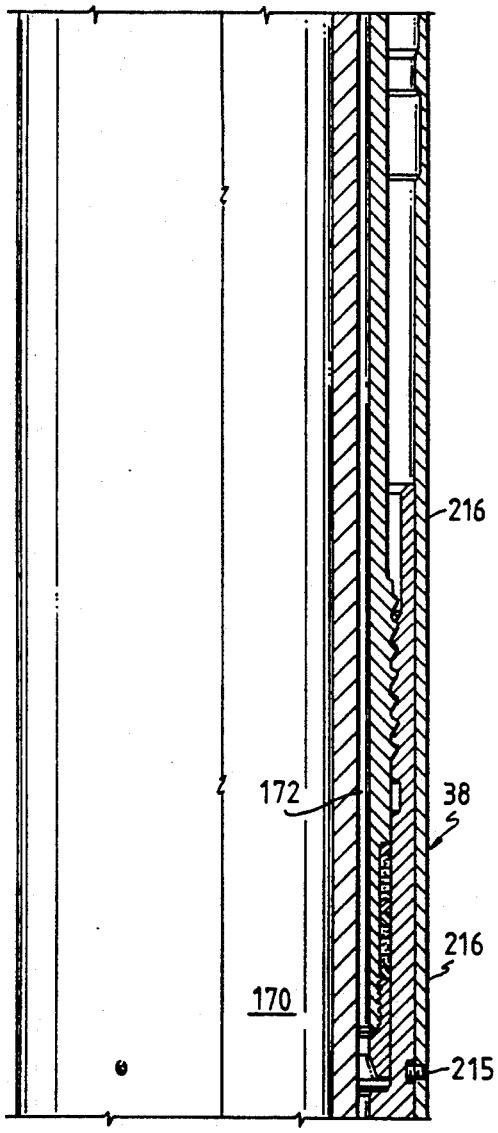
FIG.4D

FIG.9
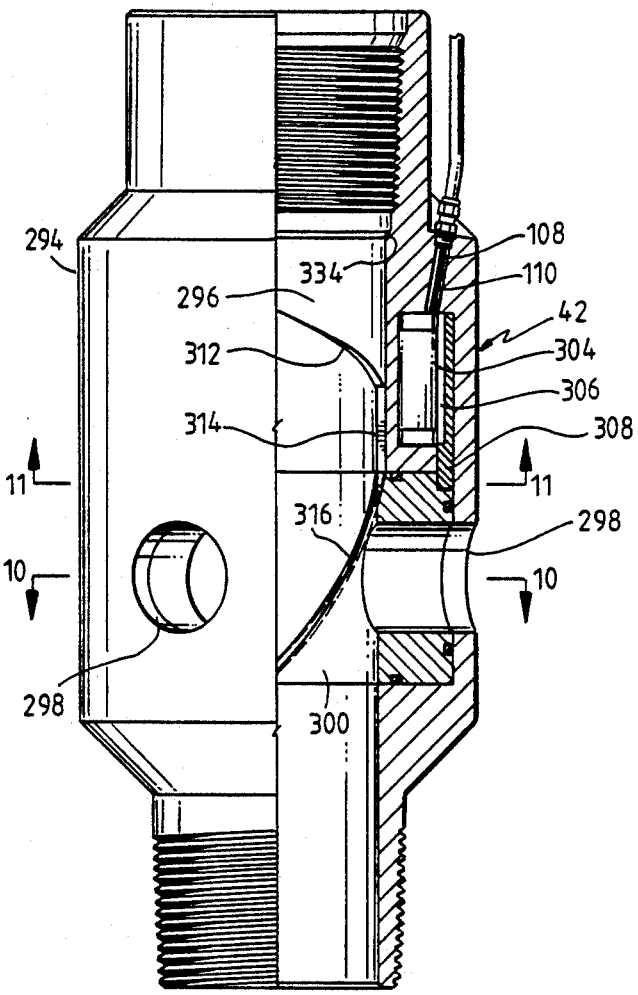
FIG.10
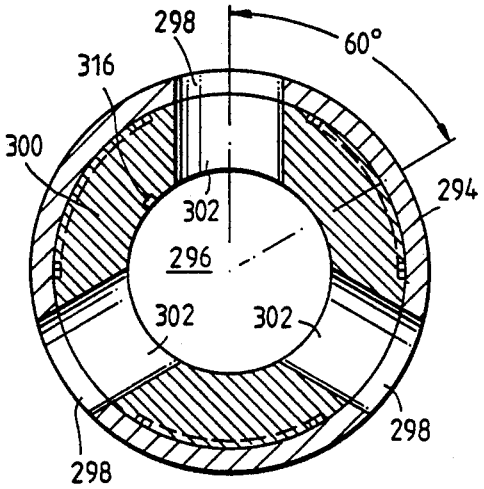
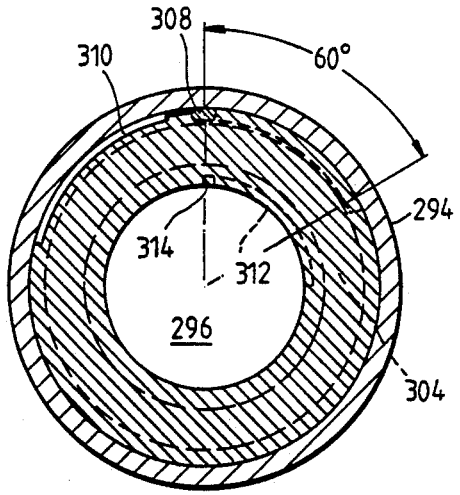
FIG.11

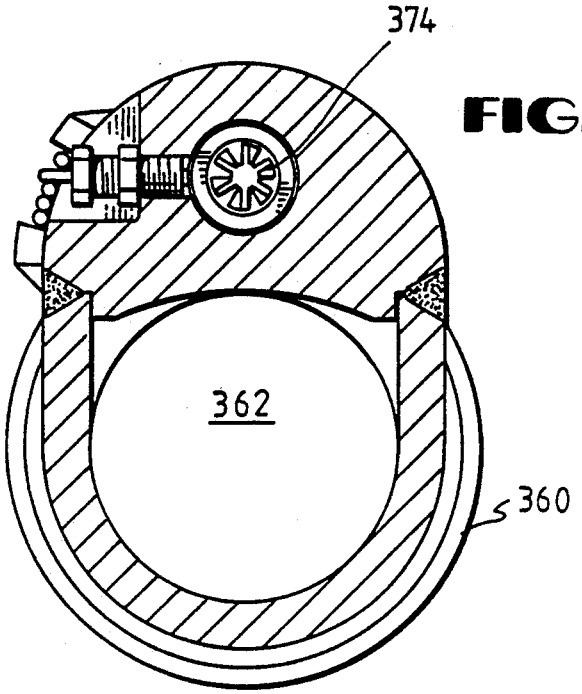
FIG.16
FIG.17
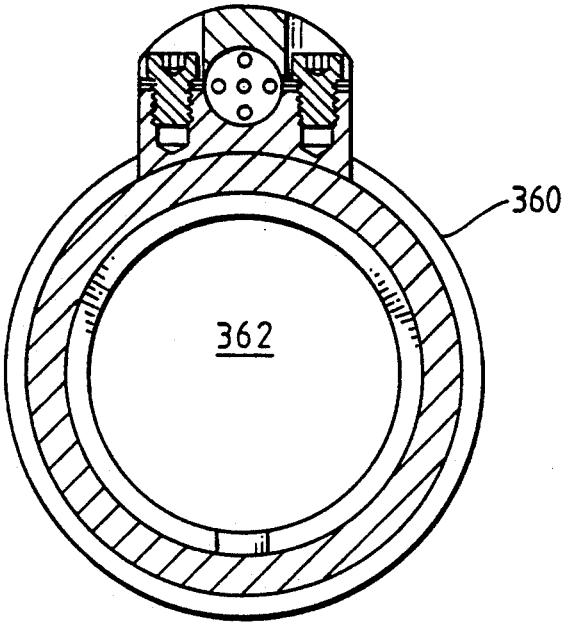

ELECTRICALLY OPERATED SAFETY RELEASE JOINT

This is a division, of application Ser. No. 07/772,828, filed Oct. 7, 1991.

BACKGROUND OF THE INVENTION

In completing oil and gas wells, particularly deep wells, subsea wells, horizontal wells, and other unique areas, it is extremely advantageous and cost effective to minimize entry into the well bore for actuating the various types of equipment to perform the initial well completion after the well tree is in place.

The present invention is directed to a method and apparatus of completing a well, such as an oil and/or gas well, or injection well, by minimizing the need for physical intervention of mechanical equipment into and out of the well bore to operate various downhole equipment, such as packers, shifting sleeves, setting plugs, etc. The mechanically actuated operation of these well devices is time-consuming and expensive, particularly in deep walls. In addition, in some types of well completions, such as in horizontal completions, it is difficult to mechanically actuate well equipment in the horizontal component of the well, or perform the usual well operations using coil tubing and gravity fed wireline operations. In addition, the individual downhole devices may include transducers to provide an electrical feedback signal to the well surface to provide surveillance, and insure that a complete and successful actuation and operation of all of the downhole devices has been performed throughout the completion procedure. That is, the downhole devices are electrically actuated in proper sequence by surface electrical controls through an electrical conductor to each individual device from the surface to complete the well. A return signal to the well surfaces indicates the functional position of each device thereby allowing the well to be brought into production safely, quickly and inexpensively.

SUMMARY

The present invention is directed to an electrically operated well completion system and method of operation for an oil and/or gas producing well having a tubing production string in a well casing.

The present invention is directed to a method of electrically and sequentially completing an oil and/or gas well by lowering a production string into a well casing in a well in which the string includes a plurality of electrically actuated well tools. The method includes electrically actuating, from the well surface, one of the well tools, sending an electrical signal to the well surface from the one well tool indicating the status of the one tool, electrically actuating another of the well tools from the well surface, and sending an electrical signal to the well surface from the other tool indicating the status of the other tool.

The electrical system includes an electrically actuated lower well packer in the production string which is electrically controlled from the well surface for sealing between the production string and the casing. A transducer is connected to the lower packer and electrically connected to the well surface for determining when the packer is set. An electrically actuated upper well packer may be provided in the production string along with a transducer for determining when the packer is set. An electrically actuated safety joint is provided in the production tubing above the upper packer for reducing the strength of the production tubing at the safety joint when actuated. An electrically actuated well annulus safety valve is connected to the production string for controlling fluid flow in the annulus formed between the production string and the casing and includes a transducer electrically connected to the well surface for determining the position of the annulus safety valve. A solenoid actuated tubing safety valve is connected to the production string for controlling the fluid flow through the production string and includes a transducer for determining its position. An electrically controlled circulating sleeve is provided in the production string between the upper and lower packers for controlling communication between the outside and the inside of the sleeve and includes transducer means leading to the well surface for measuring the position of the sleeve. Also, an electrically operated blanking block valve is provided in the production string below the circulating sleeve for blocking off fluid flow through the bore and includes a transducer for determining the position of the block valve.

A still further object of the invention is the provision of an electrically operated well completion system which is particularly useful in horizontal completions of an oil and/or gas well. This system includes an electrically actuated upper well packer having a connected transducer for determining when the packer is set, an electrically operated blanking block valve below the upper packer for blocking off fluid flow having a transducer electrically connected to the well surface. At least two inflatable well packers and positioned in the production string above the blanking block valve. An electrically actuated circulating valve is provided between the inflatable packers for controlling communication between the outside and the inside of the sleeve and includes transducer means connected to the well surface for determining the position of the sleeve. An electrically actuated safety joint is provided in the production tubing above the upper packer, a solenoid actuated safety valve is connected in the production string below the safety joint, an electrically actuated well annulus safety valve is connected to the production string, and an electrically controlled circulating means is provided in the production string between the upper packer and the inflatable packer for controlling communication between the outside and the inside of the circulating means.

Still a further object of the present invention includes the method of operating the well completion equipment electrically, sequentially, and receiving feedback for determining the actuation and completion of the various downhole devices.

Yet a still further object of the present invention is the provision of an electrically actuated well packer for use in a well for sealing between the production string and the well casing which includes a body having a bore therethrough, and initially retracted packer seal means surrounding the body and initially retracted slip means surrounding said body. Fluid actuated piston means are connected to the body for expanding and setting the slip means and the packer seal means. The body includes an initially closed fluid chamber containing a fluid source, preferably pressurized, with a frangible member initially blocking communication between the piston means and the fluid chamber. An electrical motor in the body is connected to the frangible member for breaking the member and allowing pressurized fluid in the chamber to actuate the piston means. An electrical fluid pump may be connected to the body and the chamber for supplying pressurized fluid to the chamber and the piston means. The pump is adapted to be connected to a fluid source. In addition, a pressure transducer is provided in the body measuring the pressure applied to the piston means.

A still further object of the present invention is the provision of an electrically actuated well annulus safety valve for controlling fluid flow between a production string and a casing in a well. The valve includes a housing having an inner bore and an outer passageway therethrough. Passageway valve means are connected to the housing for opening and closing the passageway and biasing means biases the valve means to the closed position. An armature is secured to the valve means and a solenoid coil is provided in the housing for attracting the armature for opening the passageway. An equalizing valve in the housing bypasses the passageway means and electrically operated means in the housing opens and closes the equalizing valve. The equalizing valve may include a rotating ring having an opening and the electrically operated means may include an electrical motor connected to the ring. The electrically actuated well annulus safety valve may include an electrically actuated well packer. The annulus safety valve may also include a transducer connected to the passageway valve and electrically connected to the well surface for determining the position of the valve.

A still further object of the present invention is the provision of a linear operated safety release joint for use in a well for initially supporting the entire production string and thereafter providing a weakened section. The safety joint includes a housing having a bore therethrough and includes first and second parts. One of the parts includes locking dogs and the other part includes a recess for receiving the dogs for initially locking the parts together for fully supporting a production string. A sleeve is slidable in the housing and initially holds the dogs in the recess and an electrical motor carried by the housing is connected to the sleeve for moving the sleeve away from the dogs. The safety joint also includes shear means releasably connecting the first and second parts together. The shear means has a breaking strength less than the strength of the dogs and recess connection. A transducer may be provided connected to the joint and electrically connected to the well surface for determining the position of the joint.

A further object of the present invention is the provision of an electrically controlled circulating sleeve for a well production string for controlling communication between the outside and inside of the sleeve. The sleeve includes a housing with a bore therethrough and includes at least one port communicating between the outside and the inside of the housing. A ring having a bore therethrough is rotatably positioned in the housing and includes at least one port for moving into and out of alignment with the port in the housing. An electric motor is positioned in the housing and is operatively connected to the ring for rotating the ring. The circulating sleeve may include an electrical transducer connected to the ring for measuring the position of the ring relative to the housing. In addition, for mechanically actuating the sleeve, the circulating sleeve may include tool engaging means in the bore of the ring for engaging and rotating the ring relative to the housing and the bore of the housing may include tool engaging means for receiving a tool for rotating the ring.

Yet a further object of the present invention is the provision of a solenoid operated blanking block valve for use in a well which includes a housing having a bore therethrough and an upwardly facing valve seat in the bore. A flapper valve closure element is positioned above the valve seat and moves between an open position to a closed position seated on the valve seat for blocking off downward flow through the bore. A flow tube is telescopically movable in the housing and upwardly through the valve seat for opening the valve and downwardly for allowing the flapper to close. Biasing means in the housing biases the flow tube upwardly for opening the valve. An armature is secured to the flow tube and a solenoid coil in the housing attracts the armature and moves the flow tube downwardly for allowing the valve to close. The blanking plug may include a transducer connected to the valve and electrically connected to the wall surface for determining the position of the valve.

Other and further objects, features and advantages will be apparent from the following description of presently preferred embodiments of the invention, given for the purpose of disclosure, and taken in conjunction with the accompanying drawings.

BRIEF DESCRIPTION OF THE DRAWINGS

FIGS. 1A, 1B, 1C, 1D and 1E form a schematic elevational view of one form of an electrically operated well completion system of the present invention, FIGS. 2A and 2B form an elevational schematic view of another embodiment of the present invention, FIGS. 4A, 4B, 4C, 4D, 4E, 4F, 4G and 4H are continuations of each other and form a fragmentary quarter section view of an electrically actuated well annulus safety valve and packer, FIG. 9 is a fragmentary elevational view, in quarter section, of an electrically controlled circulating valve of the present invention, FIG. 10 is a cross-sectional view taken along the line 10—10 of FIG. 9, FIG. 11 is a cross-sectional view taken along the line 11—11 of FIG. 9, FIG. 16 is a cross-sectional view taken along the line 16—16 of FIG. 15C, FIG. 17 is a cross-sectional view taken along the line 17—17 of FIG. 15B, FIGS. 18A, 18B, 18C and 18D are continuations of each other and form a fragmentary elevational view of the gas lift system of FIGS. 15A-15E.

DESCRIPTION OF THE PREFERRED EMBODIMENT

Figure 1A:
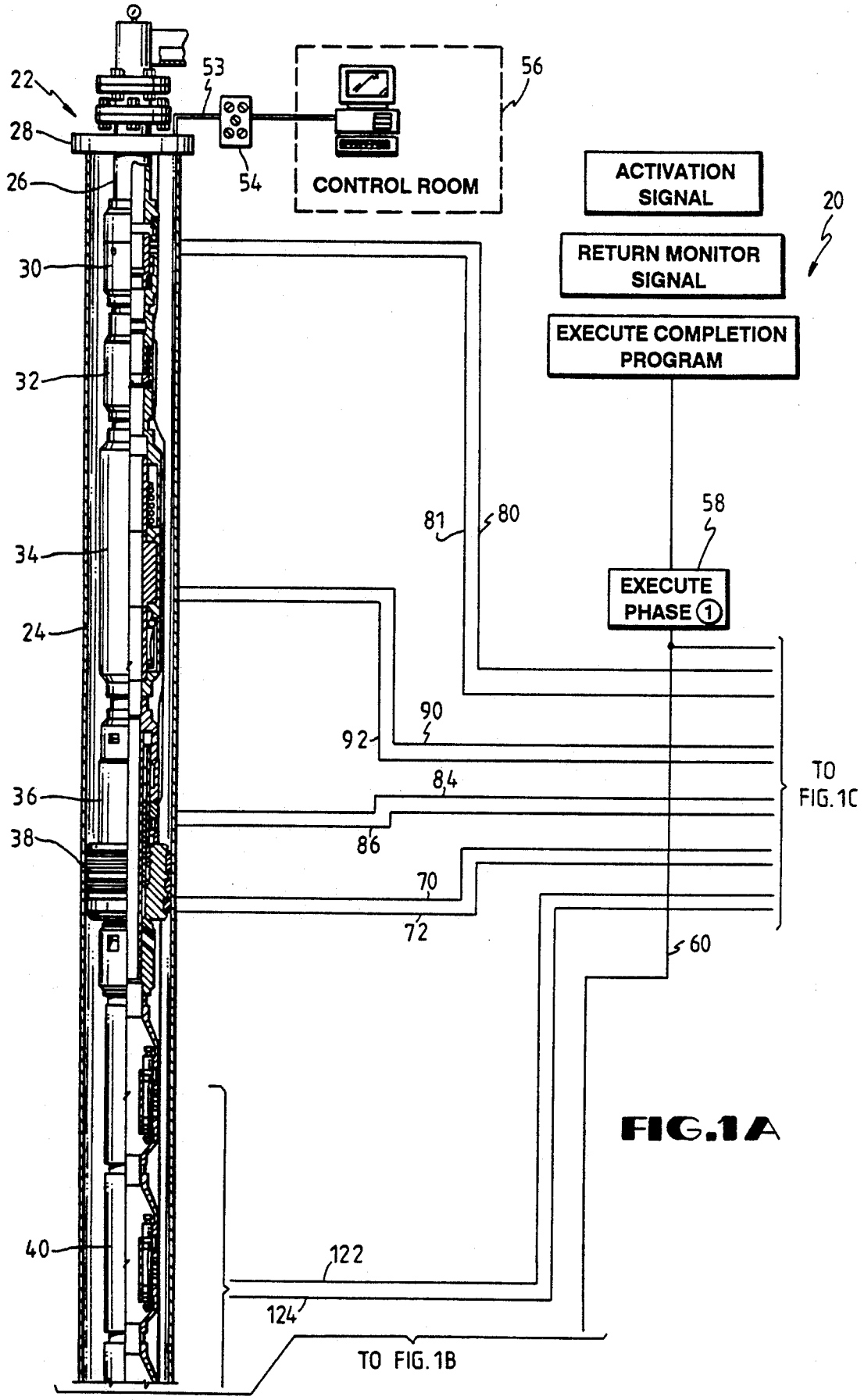

Referring now to the drawings, and particularly to FIGS. 1A-1E, the reference numeral 20 genrally indicates one embodiment of an electrically operated well completion system of the present invention. The number and types of downhole equipment used will depend upon the particular application and will vary both as to types and numbers. Therefore, the following description of the system 20 is for purposes of illustration only, and not as a limitation.

Figure 1B:
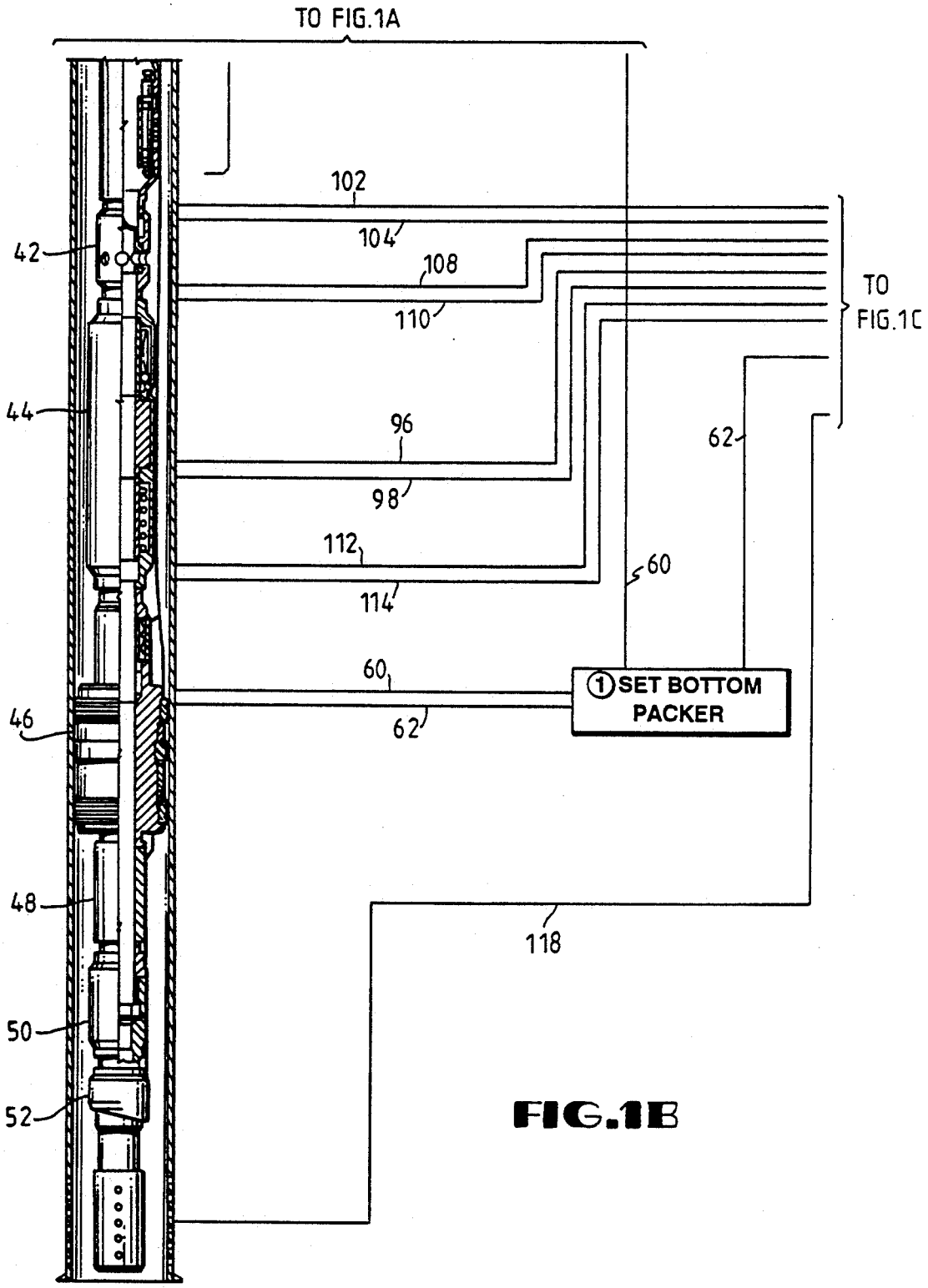
Figure 1E:
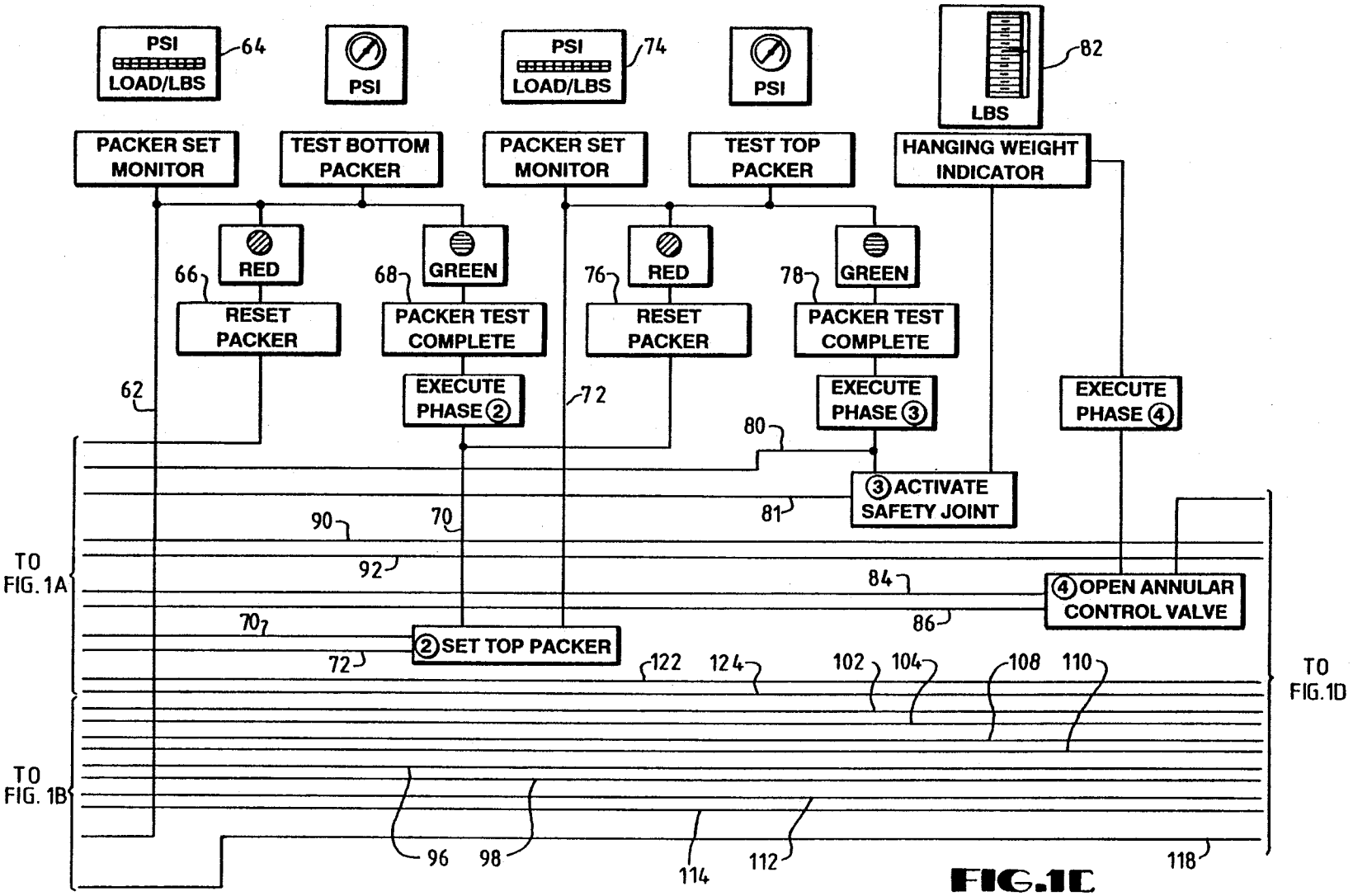
Figure 1D:
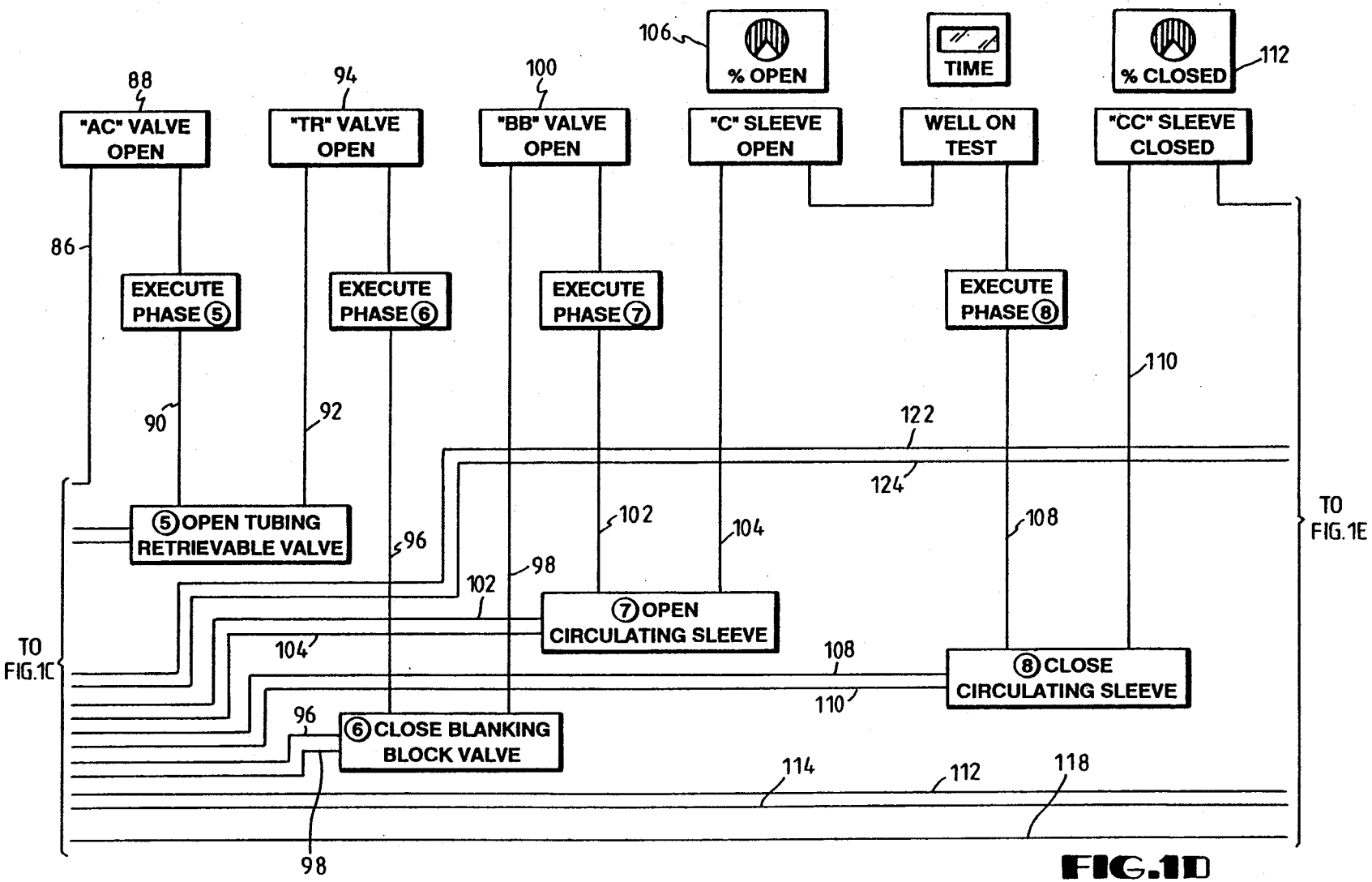
Figure 1E:
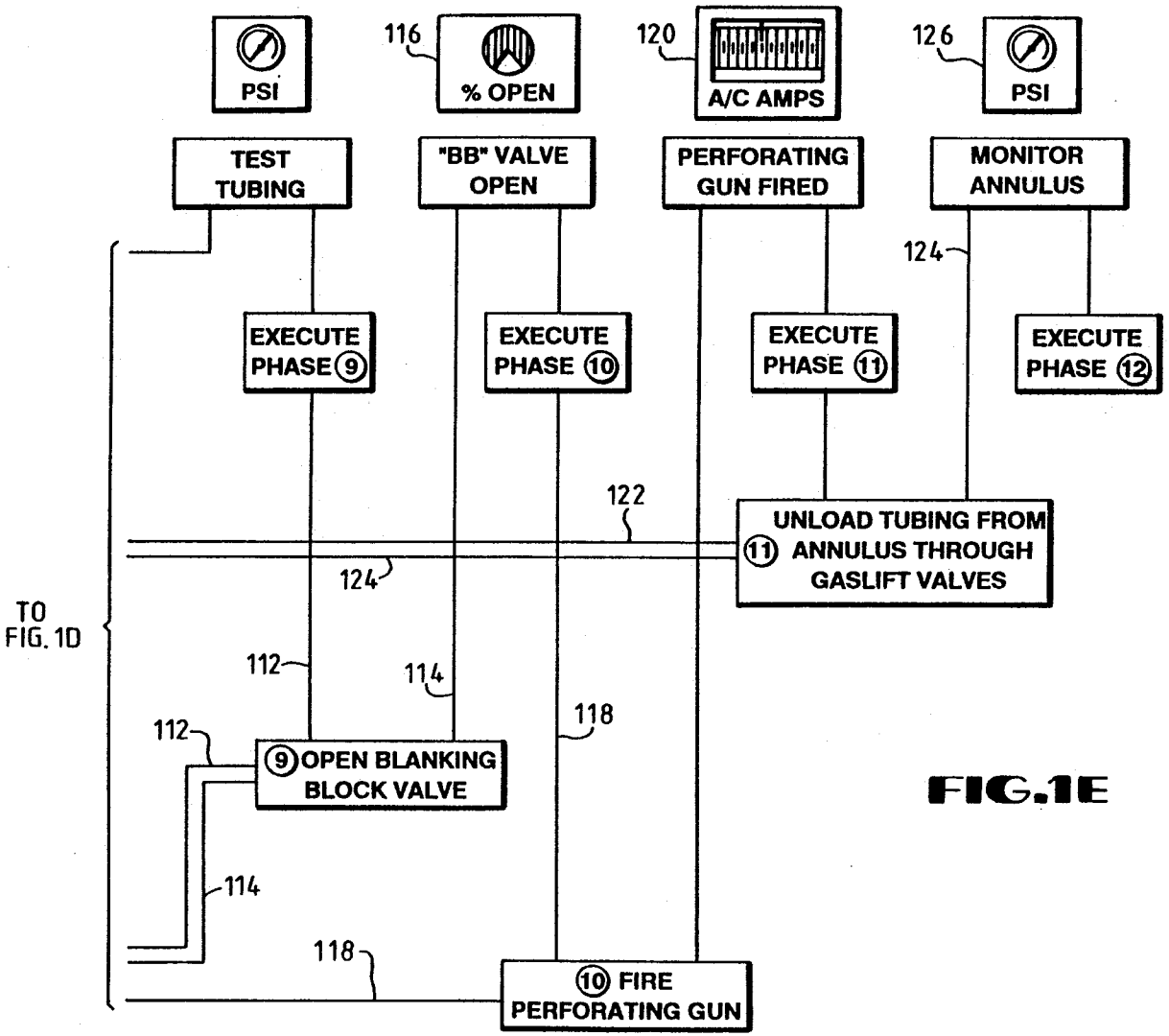

Referring now to FIGS. 1A and 1B, the well installation generally indicated by the reference numeral 22 illustrates a hydrocarbon well, such as an oil and/or gas well, having a conventional casing 24 and well production string 26 therein with a conventional wellhead 28 at the well surface.

The following types of downhole well devices may be used connected to the production tubing string 26 from top to bottom of the well: An electrically operated safety joint 30 is intentionally designed to initially support the weight of all of the production string 26, as it is inserted into the casing 24, but is thereafter intentionally designed to be the weakest section and separate at a lower force then the remainder of the tubing string 26. Thus, in the event that the wellhead 28 is destoryed, safety joint 30 will fail thereby leaving the safety systems, which are positioned below intact. A solenoid operated selective landing nipple 32 is provided for providing a landing nipple, if needed, for supporting additional well tools or instruments in the production string 26. A solenoid operated tubing safety valve 34 provides safety protection to the bore of the tubing string 26 by shutting off fluid flow upwardly from the well in the event of a disaster or problem. A solenoid operated annulus safety valve 36 is provided for opening and closing the flow of fluid in the annulus between the production tubing string 26 and the casing 24. An electrically actuated upper well packer 38 is provided for sealing the annulus between the tubing string 26 and the casing 28. An electrically operated gas lift system 40 is provided for providing gas lift to produce liquid from the well, if desired. However, in the case of a gas well, the gas lift system 40 would be omitted. An electric operated circulating sleeve is used to provide communication between the outside and the inside of the sleeve 42 for unloading the annulus and the tubing string bore prior to well production. A solenoid operated blanking blocking block valve 44 is used to block off downward flow through the bore of the tubing string 26. A lower packer 46 is electrically actuated for sealing off the annulus between the casing 24 and tubing string 26 and directing well production through the tubing string. A bottom hole production monitor 48 may be used to measure various physical properties of the well production. An instrument nipple 50 may be used to hold additional types of measuring instruments. A perforating gun assembly 52 is used to perforate the casing 24 for initiating well production.

The above described downhole devices may be electrically actuated, controlled, and monitored from the well surface through one or more electrical conductors 53 extending, preferably in the annulus, to the devices and controlled through an electrical control panel 54 and/or automatically through a computer system 56.

Referring now to FIGS. 1A and 1B, the system 20 with the various components connected to the production tubing string 26 are lowered into the casing 24 and then are available for electrical actuation in a sequential mode of operation to complete the oil and/or gas well and start production flowing up the production string 26. The completion program is begun by executing phase 1 which is step 58 which electrically actuates and sets lower packer 46 through electrical power line 60. A transducer, to be more fully described hereinafter, connected to the packer 46, sends an electrical signal back to the well surface through signal line 62 (FIGS. 1B and 1C) to a pressure readout 64 which measures the amount of pressure applied to set the packer 46 for determining whether or not the packer 46 is set. If the pressure applied to the bottom packer 46 is not sufficient for setting, a step 66 is initiated of resetting the lower packer 46. On the other hand, if the packer 46 is set and the lower packer test is indicated complete at 68, step 2 of the method of completion is initiated through electrical line 70 (FIGS. 1C and 1A) to electrically actuate and set the upper packer 38. A transducer, which will be more fully described hereinafter, is connected to the upper packer 38 and sends an electrical signal over signal line 72 to a pressure readout 74 to indicate whether sufficient pressure has been applied to the packer 38 for setting. If not, reset step 76 is performed. However, if the upper packer 36 is set, and the upper packer test complete 78 indicates that it is complete, step 3 of the method of completion may be executed. That is, at this stage of the method, the upper packer 38 is set and packs off the annulus between the casing 24 and the production string 26 as well as engages and grips the inside of the casing 24 for supporting the production string 26. Execute phase 3 sends an electrical signal over electrical line 80 (FIGS. 1C and 1A) to the electrically operated safety joint 30. The joint 30 initially is designed to support the entire production string 26 as it is lowered into the casing 24, for example, as much as 800,000 pounds. However, as will be more fully described hereinafter, the safety joint 30 is electrically actuated, after the upper packer 38 is set and assumes the support of the weight of the string 26, to lower the weight carrying capacity of the safety joint 30, such as to separate at 150,000 pounds for example. Thus, the safety joint may break off or separate in case of emergency if the wellhead 28 is damaged in order to leave all of the safety systems therebelow intact. A transducer is connected to the joint 30, as will be more fully described hereinafter, to provide an output signal over signal line 81 to indicate the actuation of joint 30. A hanging weight indicator 82 is connected to the wellhead 28 to provide an indication when the weight carried by the safety joint 30 has been transferred to the upper well packer 38. Assuming that the indicator 82 indicates the completion of step 3, step 4 of the completion method may be performed by providing an actuation signal through the electrical line 84 (FIGS. 1C and 1A) to open the annulus safety valve 36. A transducer is connected to the safety valve 36, as will be more fully described hereinafter, and provides an output signal over signal line 86 (FIGS. 1A, 1C and 1D) to indicate to readout 88 if the annulus safety valve is open. If so, the next step of the method is to execute step or phase 5 to provide an actuation signal over electrical line 90 (FIGS. 1D, 1C, and 1A) to actuate the solenoid operated tubing safety valve 34 to the open position. A transducer connected to the safety valve 34, as will be more fully described hereinafter, returns a signal over signal line 92 (FIGS. 1A, 1C and 1D) to readout 94 to indicate whether or not safety valve 34 is open. If safety valve 34 is open, the next step of the method is execute step or phase 6 which provides an actuation signal over electrical line 96 (FIGS. 1D, 1C and 1B) to blanking block valve 44 which closes. A transducer is connected to valve 44, as will be more fully discussed hereinafter, and provides a feedback signal over signal line 98 (FIGS. 1B, 1C and 1D) to readout 100. If the blanking block valve 44 is closed, the next step of the method is to execute step or phase 7 by providing an actuation signal over electrical line 102 (FIGS. 1D, 1C and 1B) to electrically actuate circulating sleeve 42. A transducer connected to sleeve 42, which will be more fully described hereinafter, provides a signal over signal line 104 (FIGS. 1B, 1C and 1D) to readout 106 which provides a read out of the position of the sleeve 42. If the sleeve 42 is correctly positioned, the next step in the method is to execute step or phase 8 by providing an electrical actuating signal over electrical line 108 (FIGS. 1D, 1C and 1B) to close the circulating sleeve 42. Return signal is transmitted over signal line 110 (FIGS. 1B, 1C and 1D) to readout 112 to determine the position of sleeve 42. Assuming sleeve 42 is closed, the next step is to executed step or phase 9 (FIG. 1E) in which an actuating signal is placed on electric line 112 (FIGS. 1E, 1D, 1C and 1B) to open the blanking block valve 44. A transducer signal is placed upon signal line 114 (FIGS. 1B, 1C, 1D and 1E) to readout 116. Assuming that the blocking valve 44 is now open, the next step is to execute step 10 to apply an actuating signal over electrical line 118 (FIGS. 1E, 1D, 1C) to the perforating gun 52 which may be of any suitable type, such as sold by Halliburton Services or Gearheart Industries. A readout 120 measures the DC current furnished to the perforating gun 52 to determine if it was actuated. Assuming the perforation gun 52 was actuated, the next step is to execute phase 11 which provides an actuating signal over line 122 (FIGS. 1E, 1C and 1A) to actuate the electrical gas lift system 40 to unload fluid in the tubing of the production string 26 by means of gas passing through the annulus and through the gas lift valves. Return data from the gas lift system 40 is returned to the well surface over signal line 124. When the readout 126 reads a sufficient pressure, the well production is coming in and the method goes to execute phase 12 directed to monitoring the flow of well fluids through the tubing string 26.

Figure 3A:
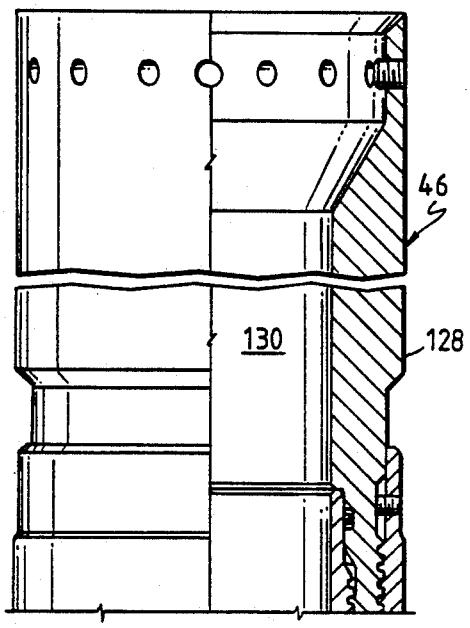
FIGS. 3A, 3B, 3C, 3D, and 3E are continuations of each other and form a fragmentary elevational view in quater section of an electrically actuated well packer of the present invention.
Figure 3B:
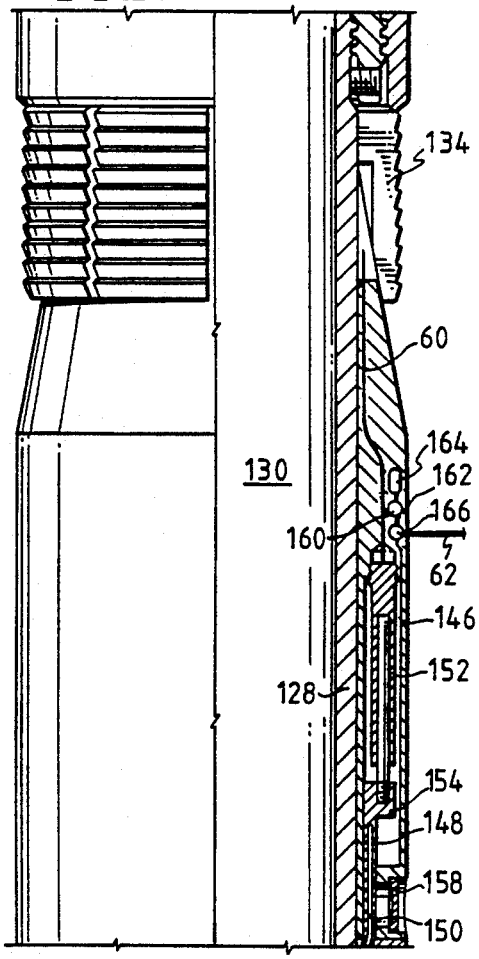
Figure 3C:
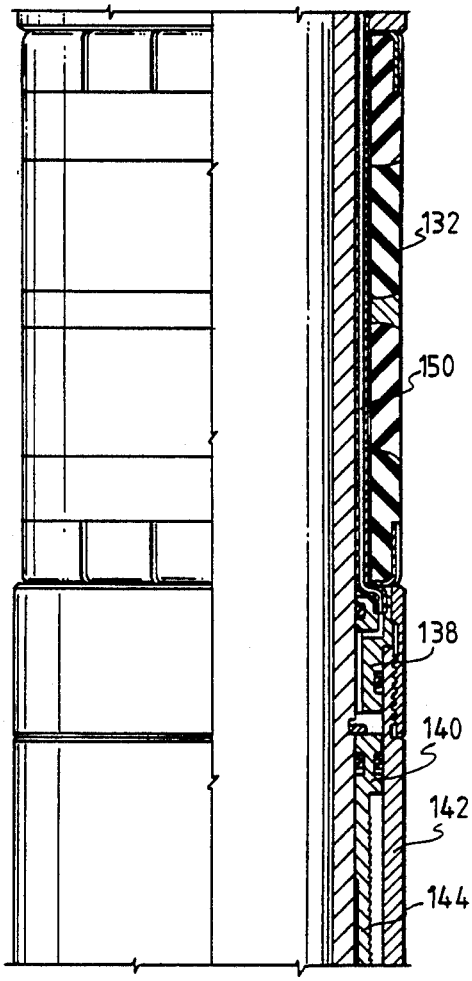
Figure 3D:
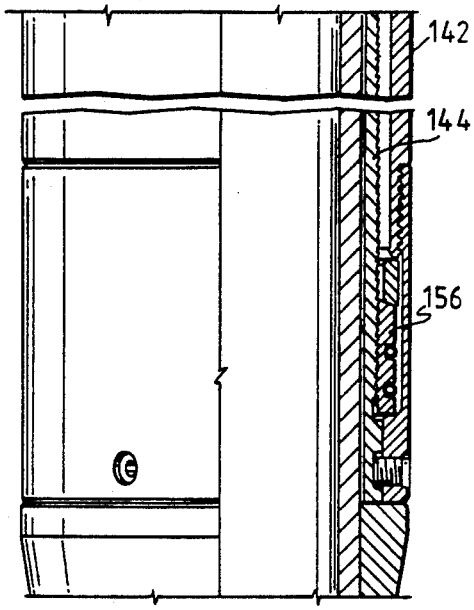
Figure 3E:
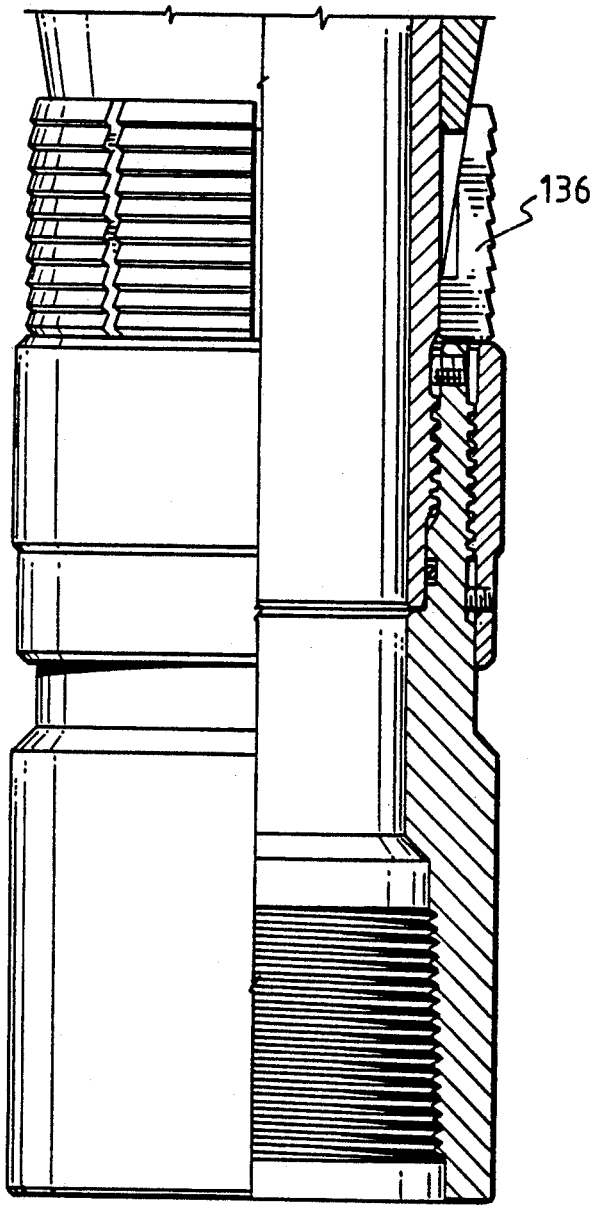

Referring now to FIGS. 3A–3E, the electrically actuated lower packer 46 of FIG. 1B is more fully shown. The packer 46 is a modified normally hydraulically set Camco HSP-1 packer. The packer 46 includes a body 128 having a bore 130 therethrough which, when the packer 46 is placed in the production tubing string 26, is aligned with the bore of the tubing string. The packer 46 includes an initially retracted packer seal means 132 (FIG. 3C) and initially retracted slip means 134 and 136 (FIGS. 3B and 3E). Fluid actuation piston means such as first piston 138 and second piston 140 (FIG. 3C) are connected respectively to sleeve 142 and 144. The electrically actuated well packer 46 includes an initially closed fluid chamber 146 (FIG. 3B) which preferably houses a precharged fixed volume of fluid such as hydraulic fluid and nitrogen for compressibility and expansion. A passageway 150 is connected to and between the chamber 146 and the first and second pistons 138 and 140. However, initially, the passageway 150 is blocked from communication with the chamber 146 by a frangible member 148. An electrical linear motor 152, which is connected to and actuated by an electrical conductor 60, is connected to a block 154 which in turn is connected to the frangible member 148. Actuation of the electrical motor 152 pulls the block 154 breaking the frangible member 148 allowing the passage of high pressure fluid from the chamber 146 through the now opened passageway 150 to between the first and second piston 138 and 140, respectively. The application of hydraulic fluid sets the packer 46 by first pushing the piston 140 downwardly moving the sleeve 144 downwardly to set the lower slips 136 thereby preventing further downward movement of the sleeve 144 and causing upward movement of the piston 138 to set the upper slips 134 and the packer seal 132. A ratchet member 156 (FIG. 3D) keeps and holds the sleeves 142 and 144 in their expanded and set position. The hydraulic fluid used in the chamber 146 may be conventional hydraulic fluid which has the property of increasing 70 psi per 1° F. rise for providing additional setting as the well bore and temperature increase during production. The motor 152 may be of any suitable type such as linear operated electrically activated. A rupture disk 158 (FIG. 3B) is provided to release any excess pressures to prevent damage to the packer 46. If desired, i.e., a mini-electrically opeated pump 160 (FIG. 3B) is housed in the body 128 and connected and actuated also from the electrical conductor 60 and has an output connected to the chamber 146 for adding to or increasing the fluid pressure in the chamber 146 if needed, or if the packer needs to be reset to provide additional fluid pressure. The pump 160 includes one or more inlets 162 connected to a fluid containing bladder reservoir 164, or connected to the annulus between the production string 26 and casing 24 for obtaining a fluid supply for pumping into the chamber 146. A transducer, such as a pressure transducer 166, is provided in the body 128 and in communication with the chamber 146 for measuring the pressure in the chamber 146. This conventional pressure transducer is connected to a signal line 62 whereby the pressure measurement in the chamber 46 is electrically transmitted to the well surface to give an indication of whether the well packer 46 is set. That is, initially the pressure reading will be high in the closed chamber 146 and after breaking the frangible member 148 will decline to a value which is sufficient enough to set the pistons 138 and 140. For a greater detail as to the other parts of the packer 46, they are similar to that shown in the normally hydraulic tubing pressure set packer more fully described in U.S. Pat. No. 3,456,723.

Figure 4A:
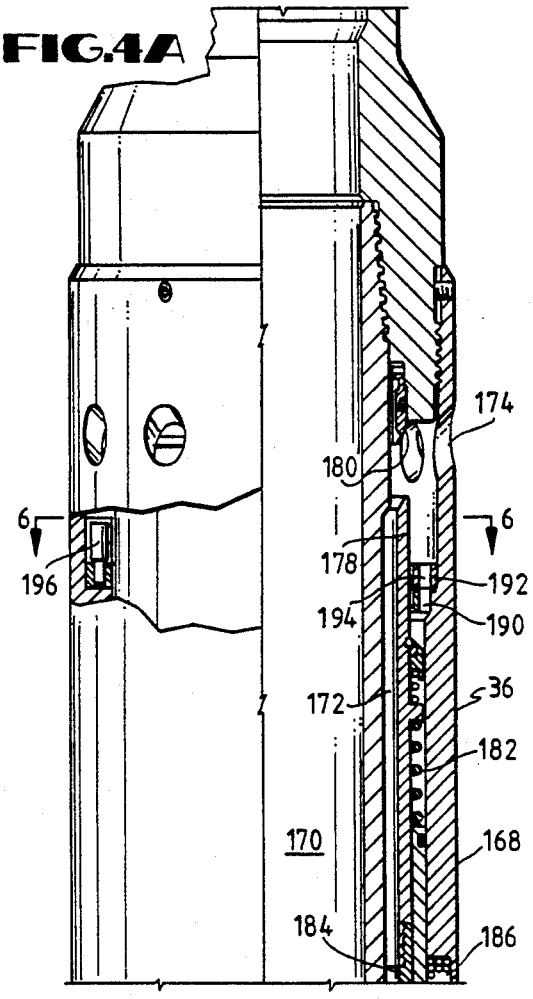
Figure 4B:
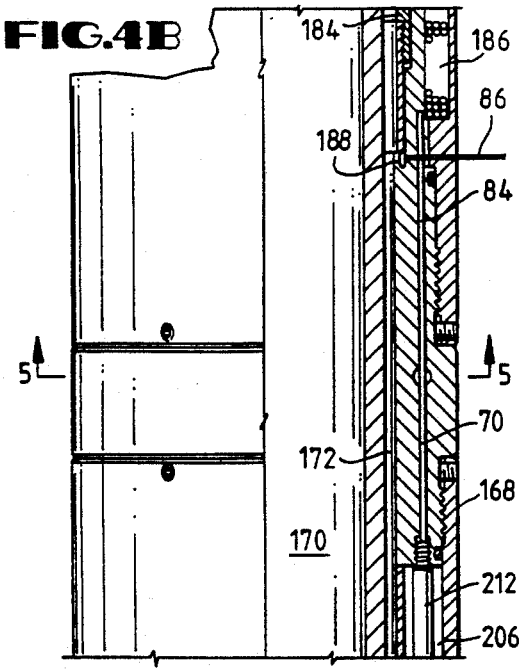

In order to protect and to control the flow of fluid through the annulus between the production tubing 26 and casing 24 as described in FIG. 1A, an annulus safety valve 36 and an upper packer 38 is provided. Annulus safety valve 36 and upper packer 38 are shown in greater detail in FIGS. 4A–4H, 5 and 6. The safety valve 36 and packer 38 include a housing or body 168 having a bore 170 therethrough which is in alignment with the bore of the production tubing string 26 generally extending from top to bottom of the housing 168. Upper ports 174 are provided at the upper end of a passageway 172 extending into the annulus (FIG. 4A) and lower ports 176 connect the passageway 172 below the packer 38 to the annulus. The valve 36 includes a passageway valve means 178 such as a longitudinal tube telescopically movable in the housing 168 for seating on a valve seat 180 (FIG. 4A) for opening and closing communication between the passageway 172 and the ports 174. Biasing means, such as spring 182, acts between the housing 168 and a shoulder on the valve means 178 biasing the valve means 178 to the closed position. In order to electrically actuate the valve means 178, an electrical armature 184 (FIGS. 4A and 4B) is secured to the valve means 178. A solenoid coil 186 is provided in the housing 168 for attracting the armature 184 and thus opening the valve means 178. The solenoid coil 186 is connected to the electrical conductor line 84 (FIG. 1A) leading to the well surface. In addition, a transducer, such as a limit switch 188 (FIG. 4B) is provided in the housing 168 and actuated when the valve means 178 is in the fully opened position. The limit switch 188 is connected to signal line 86 (FIGS. 1A and 4A) leading to the well surface for determining the position of the annulus valve 36.

Preferably, the annulus safety valve 36 includes an equalizing valve in the housing bypassing the passageway valve means 178 for equalizing pressure above and below the valve seat 180 prior to opening the valve 36 thereby protecting the valve elements. Thus, one or more equalizing ports 190 (FIGS. 4A and 6) are provided for providing fluid communication from below the safety valve 36 to above the valve seat for equalizing pressure. The equalizing ports 190 communicate with the lower portion of passageway 172 from the outside lower end of the passageway valve tube 178. A rotatable ring 192 having one or more openings 194 may be rotated to bring the openings 194 into or out of alignment with the equalizing ports 190 for opening and closing the equalizing valve. Suitable electrically operated means are provided in the housing 168, such as an electrical motor 196, which may be any suitable type, such as Model RA60-10-001, sold by BEI Motion Systems Co. for connection to and rotating the ring 192.

Figure 4C:
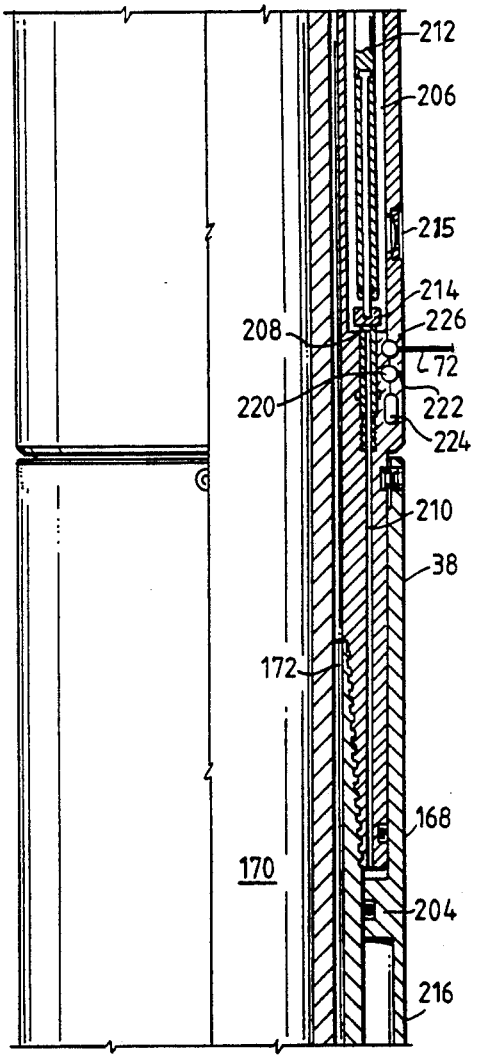
Figure 4F:
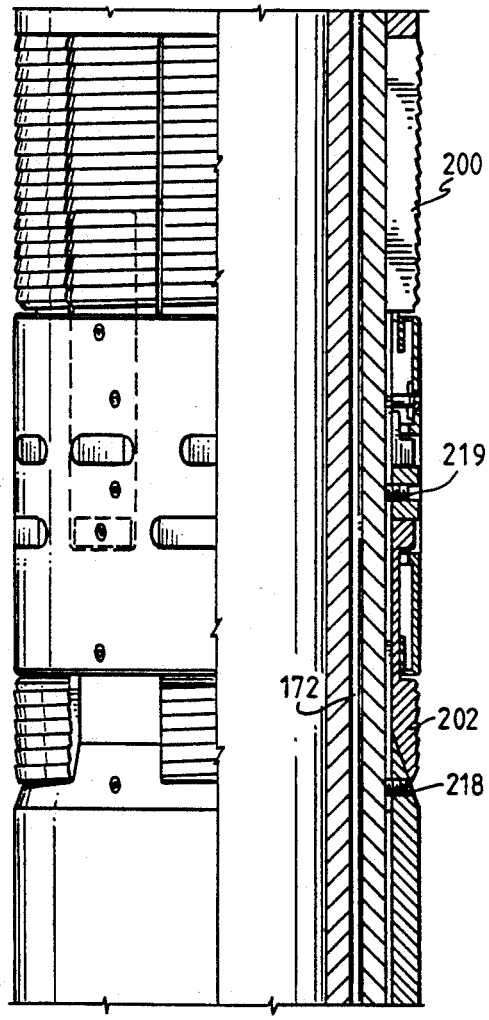
Figure 4G:
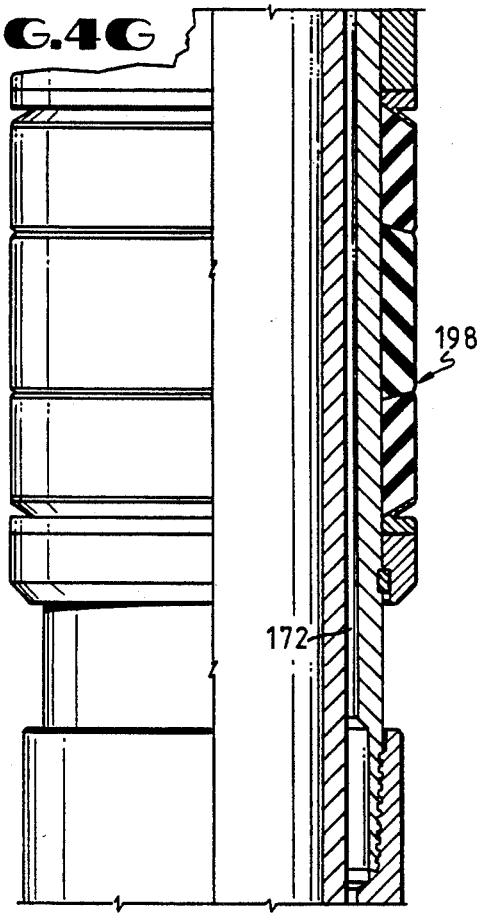
Figure 4H:
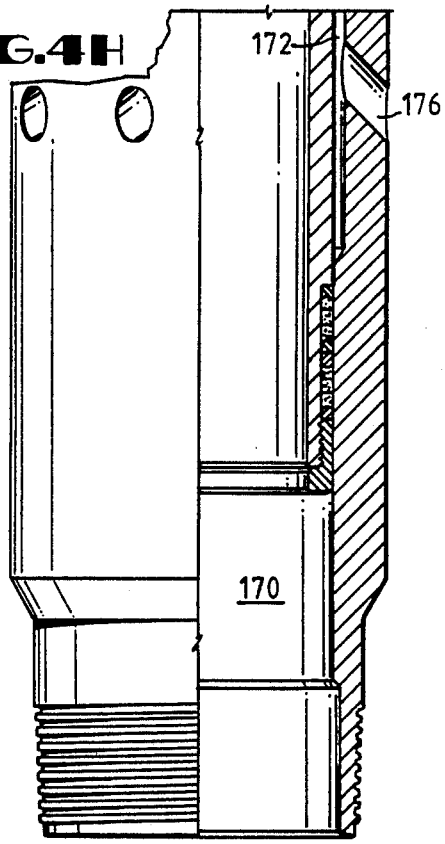
Figure 5:
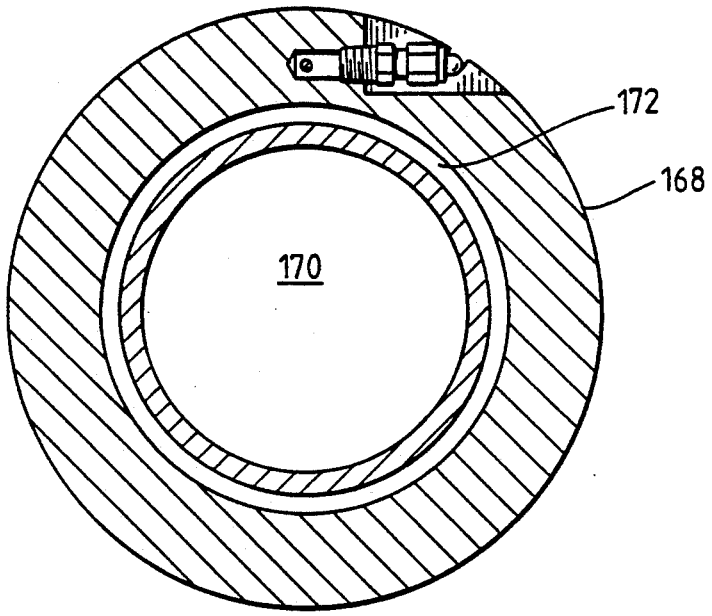
FIG. 5 is a cross-sectional view, taken along the line 5—5 of FIG. 4B.
Figure 6:
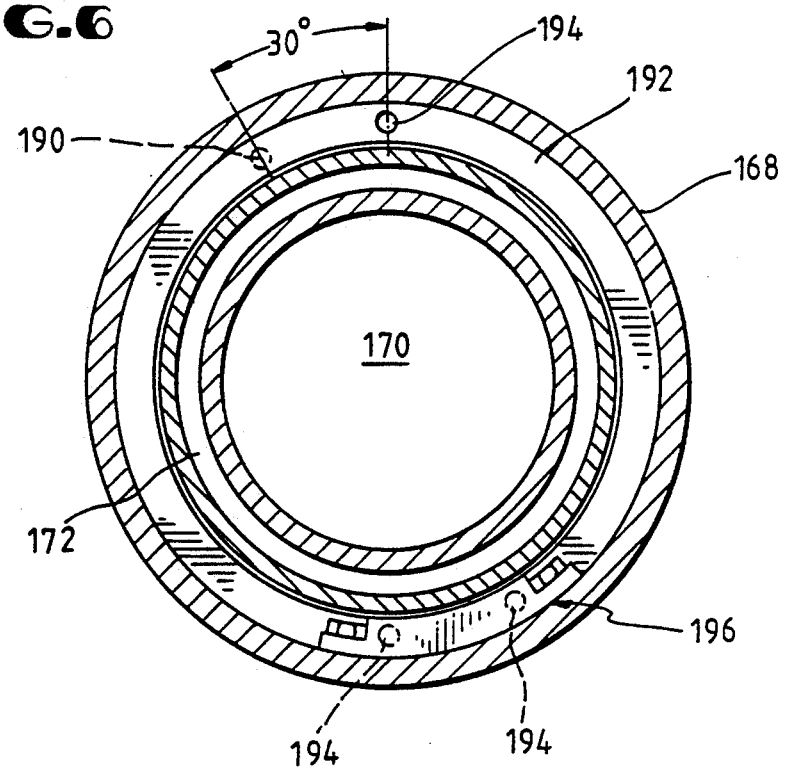
FIG. 6 is a cross-sectional view, taken along the line 6—6 of FIG. 4A, FIGS. 7A and 7B are continuations of each other and form a fragmentary, elevational view, in quarter section of an electrically operated safety release joint.

The upper well packer 38 also includes an initially retracted seal means 198 (FIG. 4G) and upper and lower slip means 200 and 202, respectively (FIG. 4F). The upper packer 38 also includes a piston 204 (FIG. 4C) for setting the packer 38. Generally, the well packer 38 is similar to a normal hydraulic actuated hydraulically set Camco HAP packer, but in the present application is electrically actuated in proper sequence. A fluid chamber is provided in the housing 168 to house a precharged fixed volume of fluid such as hydraulic fluid. The fluid is initially contained in the chamber 206 by a frangible member 208 which blocks a passageway 210 which leads to the piston 204. An electrically actuated motor, such as a linear motor similar to Model LA78-54-001 sold by BEI Motion Systems Company is connected to a block 214 which in turn is connected to the frangible member 208. Actuation of the linear motor 212 draws the block 214 upwardly breaking the frangible connection 208 and allows the passage of the high pressure fluid in the chamber 206 through the passageway 210 to actuate the piston 204. A rupture disk 215 may be provided to provide over-pressure safety. Actuation of the piston 204 moves a sleeve 216 downwardly shearing first shear pin 215 (FIG. 4D), a second shear pin 218 (FIG. 4F), and a third shear pin 219 (FIG. 4F) setting the packer seal means 198 in a set relationship with the casing 24. Further downward movement of the piston and sleeve 216 also sets the slips 200 and 202. Again, as best seen in FIG. 4C, a mini-electrically operated pump 220 may be carried in the housing 168 and connected to the fluid chamber 206 for receiving fluid from either a pump inlet 222 to the well annulus or from a bladder reservoir 224 in order to increase and supply fluid pressure in the chamber 206. A transducer, such as a pressure transducer 226, is connected to the fluid chamber 206 and sends an electrical signal to the well surface over signal line 72 to provide an indication of the pressure in the chamber 206 and thus a determination of the position status of the upper packer 38.

Figure 7A:
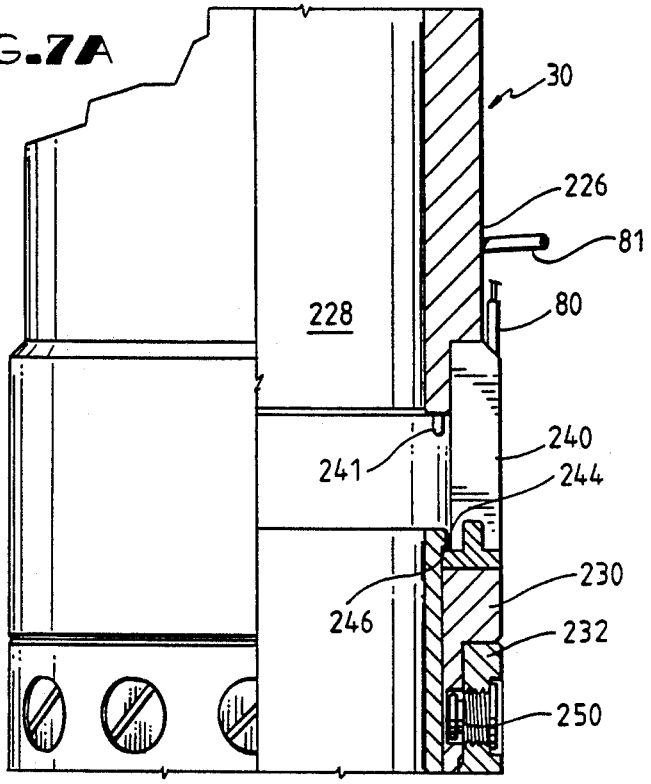
Figure 7B:
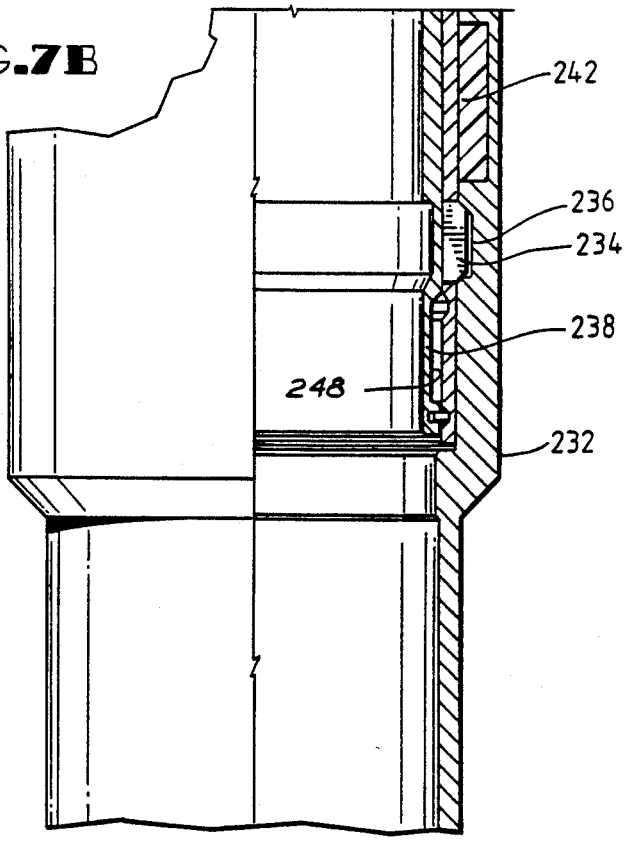

Referring now to FIGS. 7A and 7B, a more detailed explanation and description of the electrically operated safety release joint 30 is best seen. The safety joint 30 is adapted to be positioned in the production tubing string 26 and initially supports the entire production tubing string 26 as it is installed into the casing 24. Since the production tubing string 26 can be extremely heavy, for example, as much as 800,000 pounds, the joint 30 must be designed to carry the entire weight. However, the purpose of the safety joint is that it is designed to be the weakest section in the tubing string 26 so that in an emergency if the wellhead 28 is damaged or destroyed, the safety joint is designed to separate at a low force, for example, 150,000 pounds, and therefore leave all of the safety systems therebelow intact and in position to protect the well. The safety joint 30 includes a housing 226 having a bore 228 therethrough. The bore 228 is in alignment with the bore of the tubing string 26. The housing 226 includes a first part 230 and a second part 232. The first part 230 includes a plurality of locking dogs 234 and the second part 232 includes a recess 236 for receiving the dogs 234 for initially locking the first part 230 and the second part 232 together for initially supporting the entire weight of the production string 26. A sleeve 238 is slidable in the housing 226 and initially backs up and holds the locking dogs 234 locked in the recess 236. Seal means 242 are provided between the first part 230 and the second part 232 for providing a fluid tight safety joint 30.

An electric motor 240, such as a linear motor, similar to Model No. LA78-54-001, sold by BEI Motion Systems Company is carried in the housing 226 and is connected to the sleeve 238 by coacting shoulders 244 and 246, respectively, between the motor 240 and the sleeve 238. Actuation of the motor 240 pulls the sleeve 238 upwardly allowing the dogs 234 to move out of the recess 236 in the second part 232 and move into an opening 248 in the sleeve 238. However, even after disconnection of the dogs 234 from the recess 236, the first part 230 and the second part 232, are held together by one or more shear pins 250. However, the strength of the shear pins 250 are less than the dogs 234 thereby providing a lower strength safety joint 30. A transducer, such as limit switch 241, is positioned in the joint 30 to be actuated by the movement of the sleeve 238 to provide an electrical signal to the well surface over signal line 81.

Figure 8A:
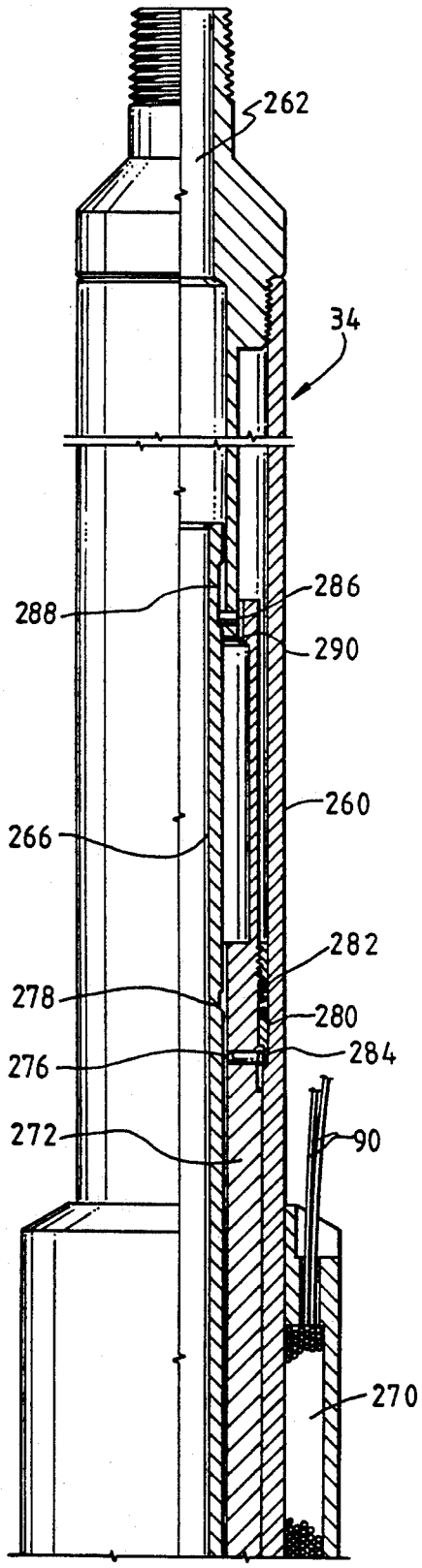
FIGS. 8A and 8B are continuations of each other and form an elevational view, in quarter section, of a solenoid actuated well tubing safety valve used in the present invention.
Figure 8B:
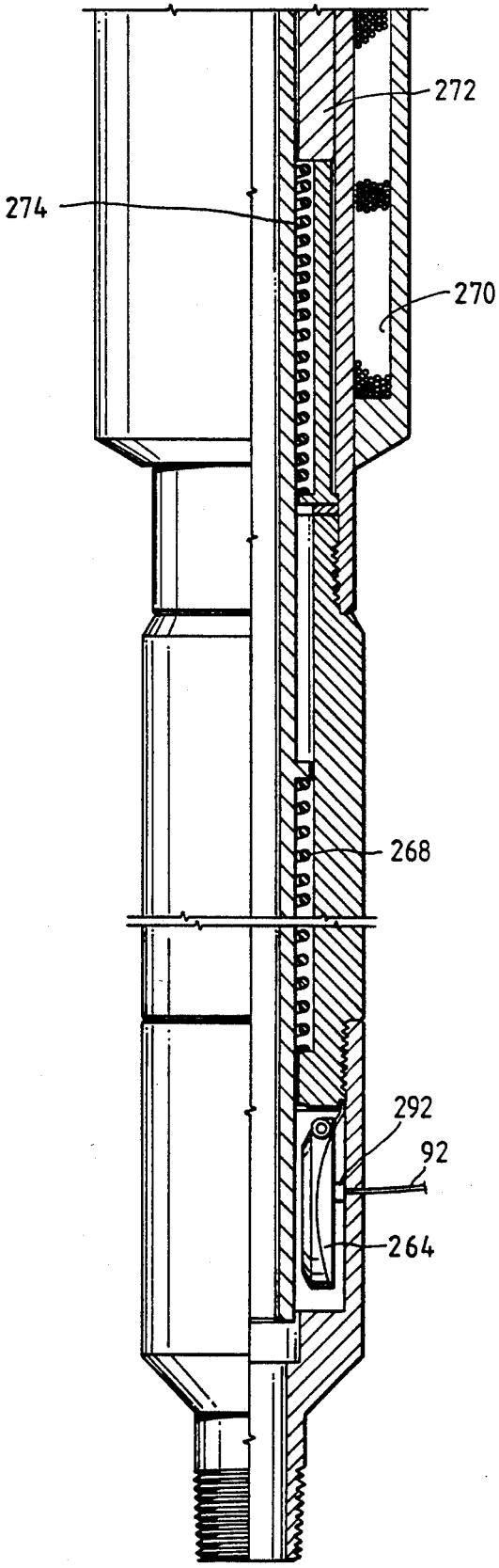

While any suitable electrically operated safety valve may be used for the safety valve 34 (FIG. 1A), one satisfactory type of electrical safety valve is shown in FIGS. 8A and 8B which is more fully described in U.S. Pat. No. 4,566,534, which is incorporated herein by reference. Thus, the safety valve 34 may include a housing 260 having a bore 262 therethrough for alignment with the bore of the production tubing string 26. A flapper valve 264 is pivotally positioned in the bore 262 for moving between an open position as best seen in FIG. 8B and a closed position. A flow tube 266 is telescopically movable in the housing 260 for controlling the movement of the flapper valve 264. When the flow tube 266 is moved downwardly, it moves the flapper 264 off of its seat thereby opening the valve.

Biasing means, such as spring 268, biases the flow tube in a direction to allow the valve 34 to close. A solenoid electrical coil 270 is connected in the housing 260 and energized by electrical line 90 for energizing the coil 270. A magnetic armature 272 is telescopically movable in the housing 260 and is adapted to be attracted by the solenoid coil 270 and moved from an upward position to a downward position as best seen in FIGS. 8A and 8B for moving the flow tube 260 to a downward position. When the coil tube 70 is deactuated, the armature 272 will move upwardly by the action of a spring 274.

A first releasable lock means is provided for connecting the armature 272 to the flow tube 266 whereby the attraction of the armature 272 by the solenoid 270 will move the flow tube 266 downwardly. Thus, a first dog 276 is movably carried by the armature 272 and movable radially towards the flow tube 266. The flow tube 266 includes a locking notch 278 for initially receiving the dog 276 for releasably locking the flow tube 266 to the armature 272. The dog 276 is initially held in the locked position by locking shoulder 280 which is biased to a locking position by a spring 282. As best seen in FIG. 8A, when the armature 272 and flow tube 266 are moved downwardly, the shoulder 280 will contact a stop shoulder 284 in the housing 260 releasing the dog 276 from the notch 278. However, a second releasable lock means holds the flow tube 266 in the open position prior to the release of the dog 276. The second releasable lock means includes a radially movable dog 286 which is adapted to be moved into a holding notch 288 in the flow tube 266 by movement of a locking shoulder 290. When it is desired to close the valve 34, the solenoid coil 270 is deenergized, the spring 274 will move the armature 272 and its connected locking shoulder 290 upwardly thereby releasing the second dog 286 and the spring 268 will move the flow tube 266 upwardly to allow the flapper valve 264 to close. It is to be noted that a transducer such as a limit switch 292 (FIG. 8B) is actuated by movement of the flapper valve element 264 to provide an electrical signal over line 92 to provide a determination of the position of the safety valve 34.

The electrically operated circulating sleeve 42 of FIG. 1B is shown in greater detail in FIGS. 9, 10 and 11. The circulating sleeve 42, sometimes referred to as a sliding sleeve, form an integral part of the production string 26, and is used as a communication device between the annulus between the production string and the casing 24 and the bore of the production string 26. This communication provides circulation to displace completion fluid and clean up the well before production and also to lift kill fluid from the production bore to bring the well on stream. The circulating sleeve 42 includes a housing 294 having a bore 296 therethrough which communicates with the bore of the tubing string 26. The housing 294 includes at least one port here shown as three ports 298 communicating between the outside and the inside of the housing 294. A ring 300 having a bore therethrough is rotatively positioned in the housing 294 and includes at least one port, such as ports 302, for moving into and out of alignment with the ports 298 in the housing 294. An electrical motor 304 having a rotatable part 306, which may be of any suitable motor such as DXP-15 500 Series sold by BEI Motion Systems Company, includes a pin 308 which is connected to the rotatable ring 300. Thus, actuation of the motor 304 through electrical line 108 actuates the rotatable ring 300 to bring the ports into and out of alignment. A suitable transducer 310 is connected to the pin 308 for providing a signal output over line 110 indicating the position of the circulating sleeve 42. If desired, a telescoping sleeve (not shown) may be used in place of the ring 300 and actuated by a linear motor to open and close the ports 298.

While it is desirable that the circulating sleeve 42 of the present invention be electrically actuated, it is also desirable that it have a mechanical backup in order to close the sleeve 42 in the event of a failure of the electrical components. Thus, a conventional muleshoe helical guide surface 312 is provided in the bore 296 (FIG. 9) and having a slot 314 (FIGS. 9 and 11) for receiving a manual tool for mechanically rotating the sleeve 300. In addition, a groove 316 is provided in the inner periphery of the ring 300 for receiving the tool. The groove 316 is arcuate so as to cause the ring 300 to rotate when actuated by a well tool.

Figure 12:
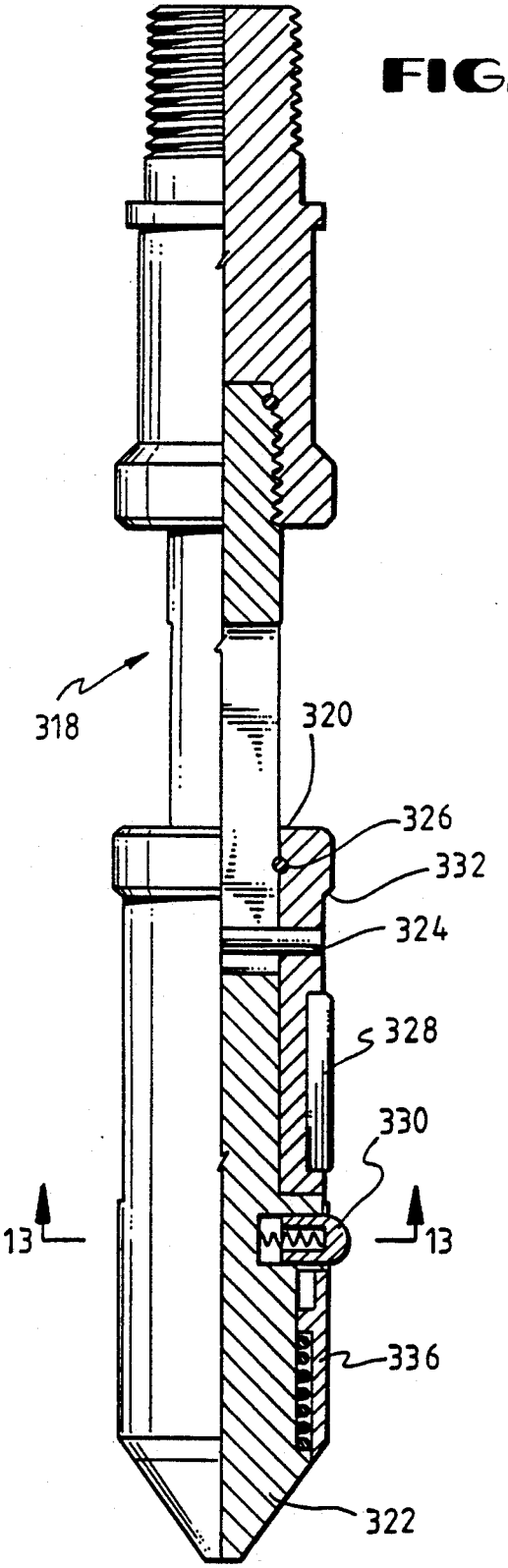
FIG. 12 is an elevational view, in quarter section, of a mechanically actuated tool for mechanically actuating the circulating sleeve of FIG. 9.
Figure 13:
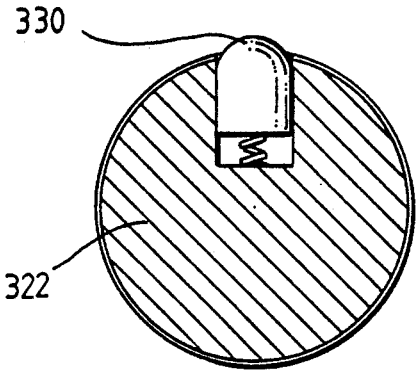
FIG. 13 is a cross-sectional view taken along the line 13—13 of FIG. 12, FIGS. 14A, 14B, 14C, 14D, and 14E are continuations of each other and form a fragmentary elevational view, in cross section, of a solenoid operated blanking block valve of the present invention, FIGS. 15A, 15B, 15C and 15D form a fragmentary elevational view, in cross section, of a solenoid controlled gas lift system useful in the present invention.
Figure 14A:
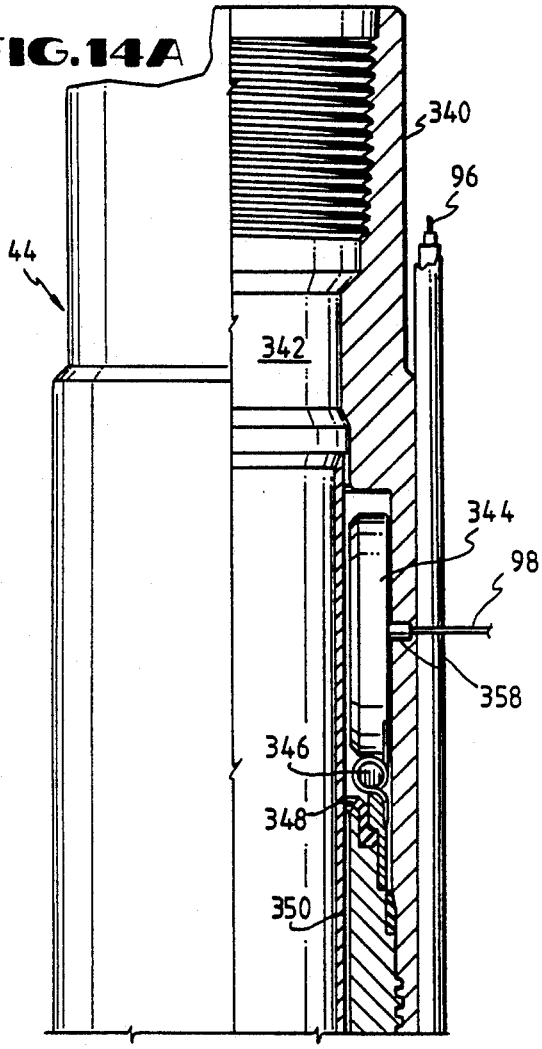
Figure 14B:
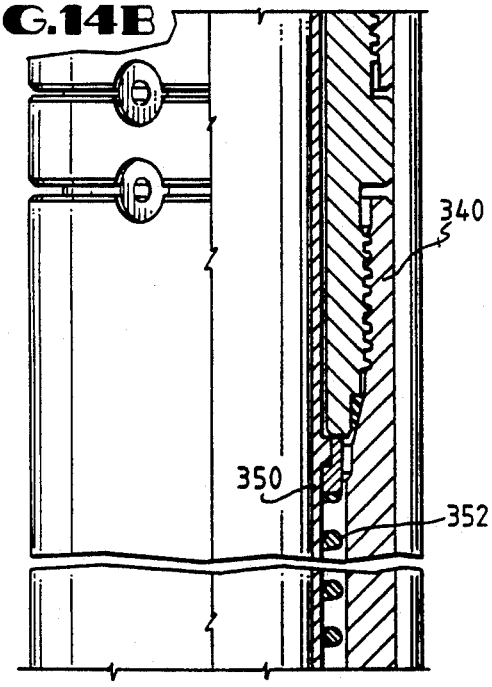
Figure 14C:
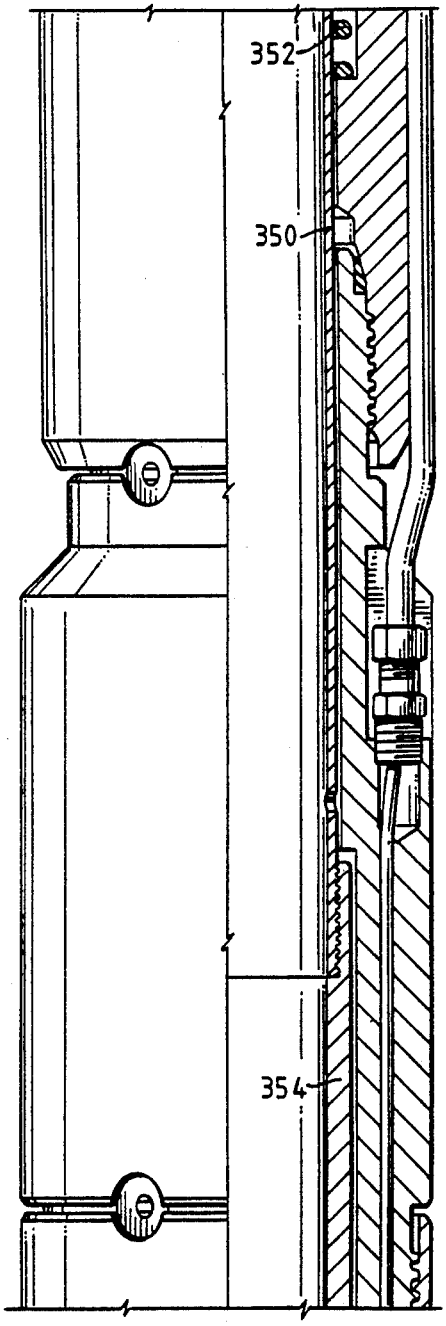
Figure 14D:
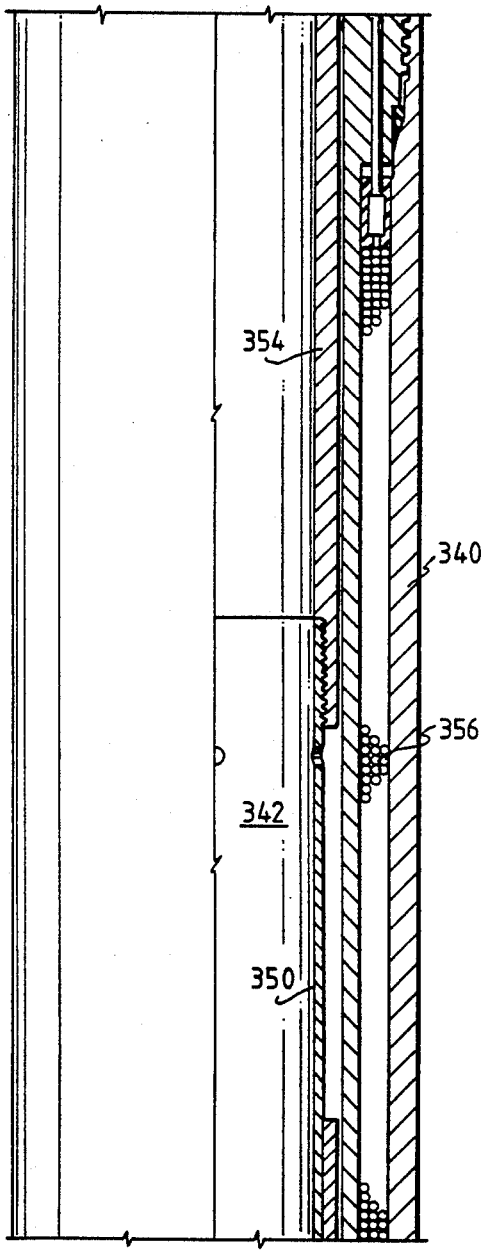
Figure 14E:
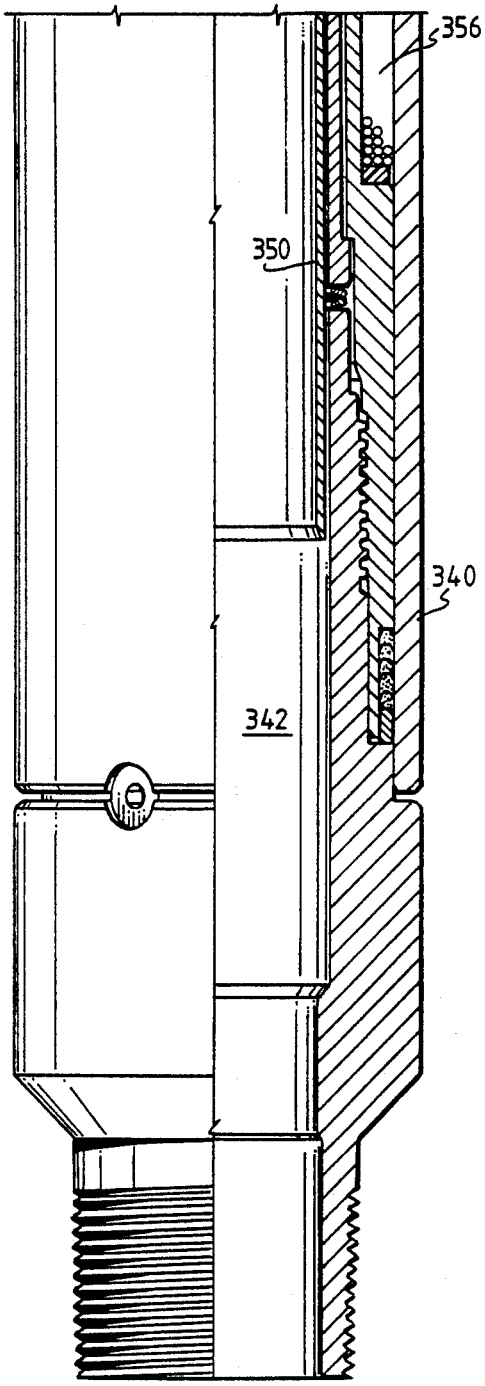

Referring now to FIGS. 12 and 13, a suitable mechanical well tool 318 is shown for mechanically rotating the ring 300. The well tool 318 is lowered through the bore of the tubing string 28 along with suitable weights. The tool 318 includes a first part 320 and a second part 322 which are rotationally pinned by roll pin 324 and initially prevented from longitudinal relative movement by shear pin 326. The first part 320 includes an orienting key 328, and the second part 322 includes a sleeve rotating button 330. When the tool 318 is lowered into the bore 296, the orienting key and button 330 follow the muleshoe curve 312 and rotate into the slot 314 until the no-go shoulder 332 on the first part 320 encounters a stop shoulder 334 (FIG. 9) on the housing 294. Downward jarring on the tool 318 shears the pin 326 allowing the part 326 to move further downwardly with the button 330 following the curve 316 and rotating the ring 300 to the proper closed position. At the bottom of the curve 316, a ramp depresses the spring actuated button 330, allows the cover 336 to hold the button in the retracted position and the tool 318 may be removed. That is, after seating the tool 318, the orienting key 328 maintains alignment of the button 330 and prevents its rotation by the roll pin 324 resulting in rotation of the ring 300.

The solenoid operated blanking block valve 44 of FIG. 1B is shown in greater detail in FIGS. 14A-14E. The valve 44 includes a housing 340 having a bore 342 therethrough for alignment with the bore of the production tubing string 26. The valve 44 includes a valve closure member such as flapper valve 344 which is positioned in the bore 342 and connected to a pivot 346 for seating on a valve seat 348. When the flapper 344 is seated on the seat 348, it blocks off downward flow through the bore 342. A flow tube 350 is telescopically movable in the housing 340 and upwardly through the valve seat 348 for opening the valve 44 and moving downwardly for allowing the flapper valve element 344 to close. Biasing means, such as spring 352, is provided in the housing 340 acting on the flow tube 350 to bias it upwardly for opening the valve 44. An armature 354

(FIG. 14C) is connected to the flow tube 350. A solenoid coil 356 is provided connected to the electrical conductor 96 (FIGS. 1B and 14A) for actuating the solenoid 356. When the solenoid 356 is actuated, it attracts the armature 354 which moves the flow tube 350 downwardly allowing the flapper valve element 344 to close.

A transducer 358, such as a limit switch (FIG. 14A), is provided in the housing 340 and adapted to be contacted by the flapper valve element 344. The transducer 358 is electrically connected to the signal line 98 to the well surface for determining the position of the blanking block valve 44.

Figure 15A:
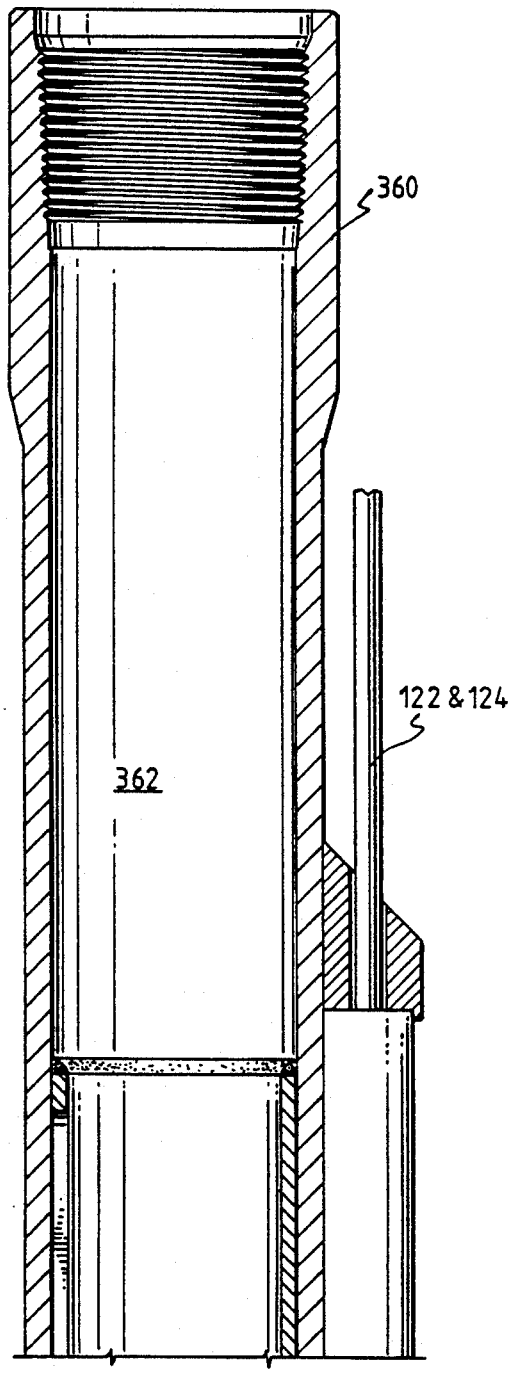
Figure 15B:
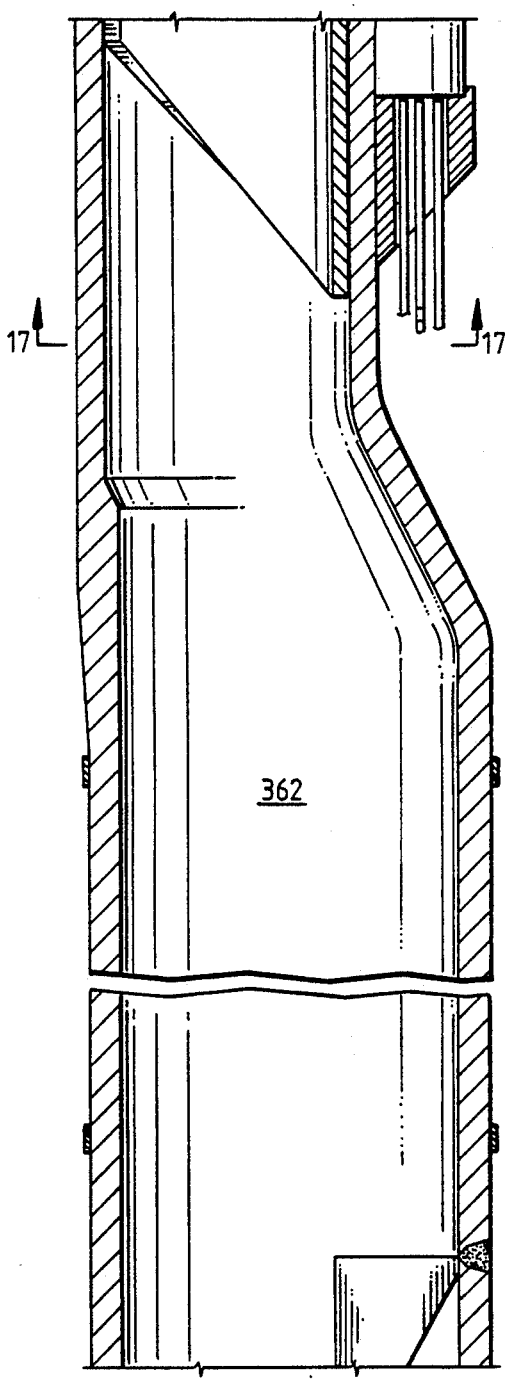
Figure 15C:
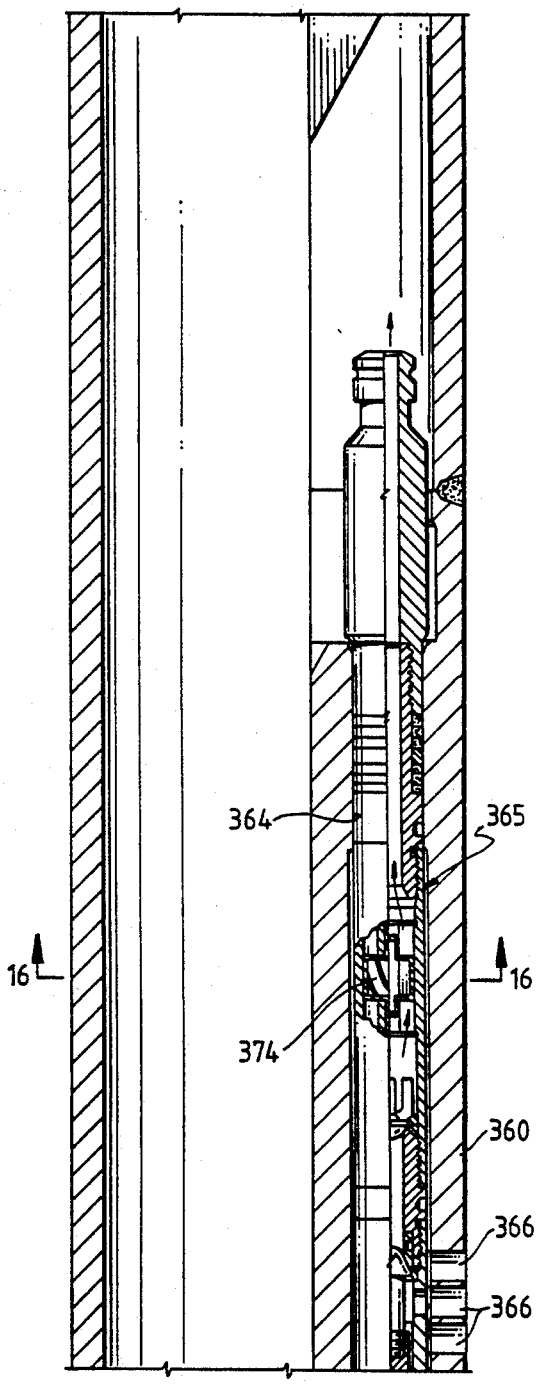
Figure 15D:
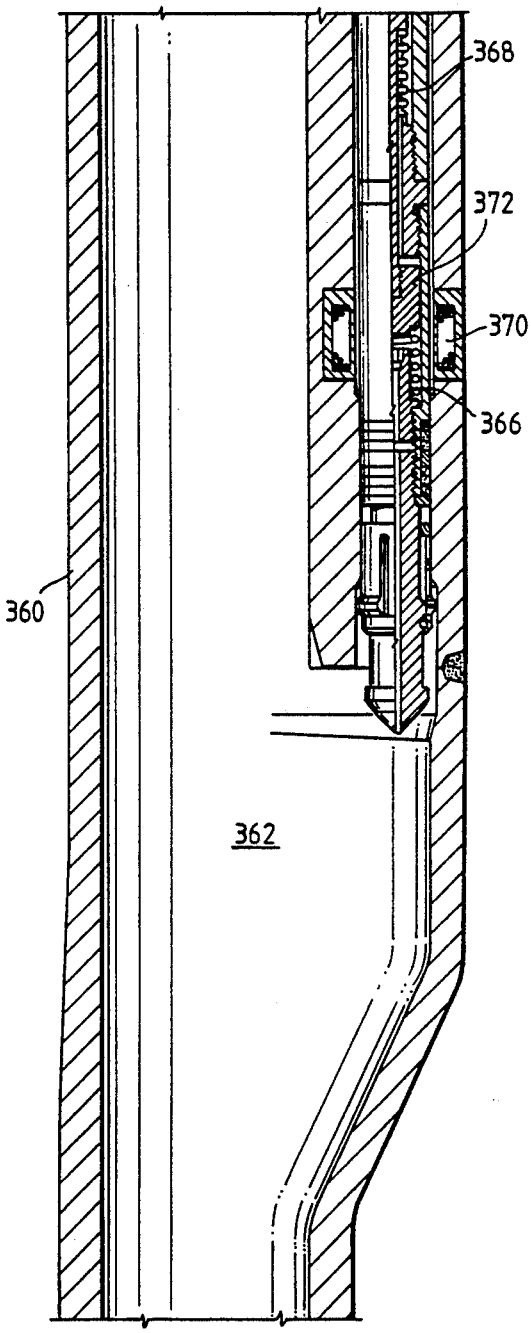
Figure 18A:
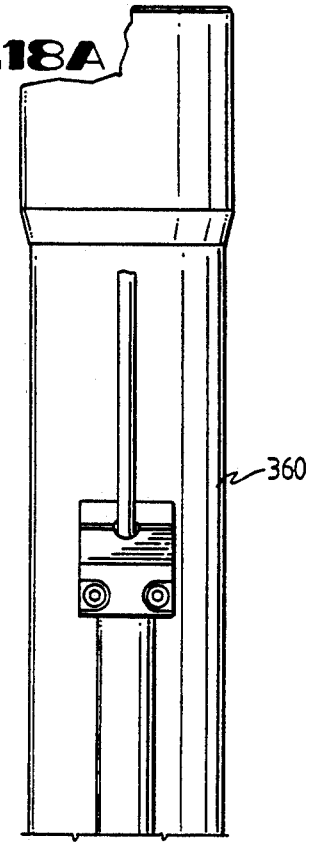
Figure 18C:
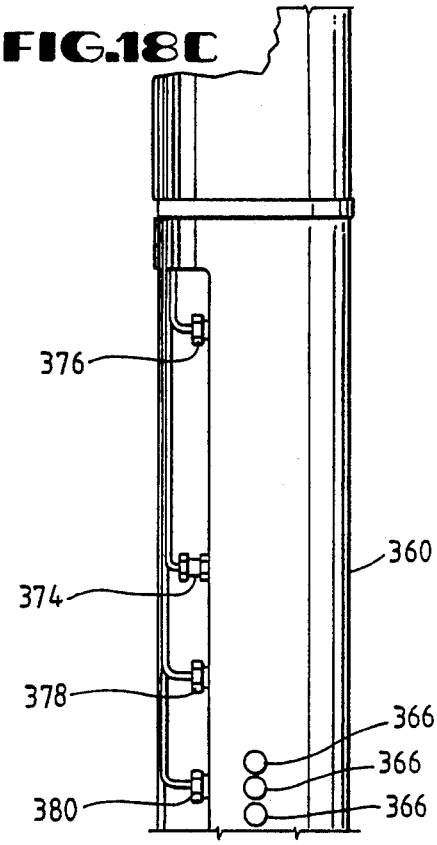
Figure 18B:
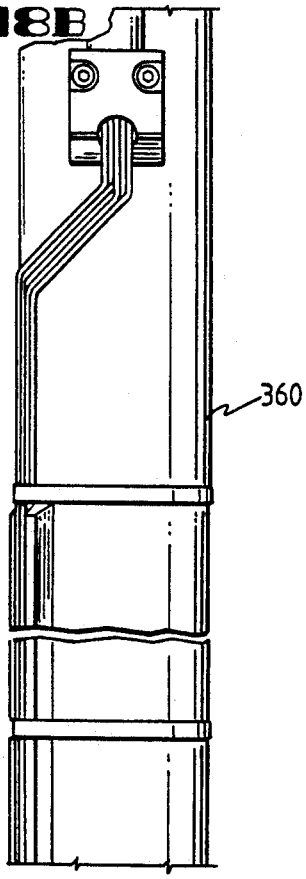
Figure 18D:
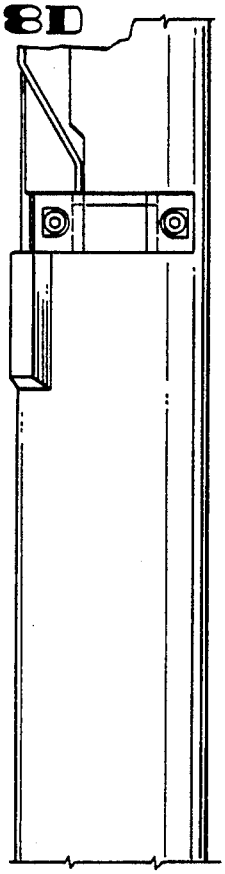

The electrically operated gas lift system 40 of FIGS. 1A and 1B may include any suitable electrical gas lift system such as the EGLF system of Camco International Inc. The system 40 may include any desirable number of gas lift mandrels and valves. A fuller illustration and description of a single mandrel and valve is shown in FIGS. 15A–18B. A sidepocket mandrel 360 is provided, such as a type KBUG-PM mandrel having a main bore 362 in alignment with the bore of the tubing string 26 and a sidepocket 364 (FIG. 15C) for receiving a solenoid controlled gas lift valve such as a type BKE-TM which is wireline retrievable into and out of the sidepocket 364. The mandrel includes a plurality of ports 366 leading from the outside or annulus into the sidepocket 62. In addition, the mandrel 360 includes a solenoid coil 370 for attracting the armature 372 of the gas lift valve 365. The valve 365 also normally includes a closing spring 366 to bias the valve to the closed position and a bellows 368 for eliminating the pressure effect. The solenoid 370 is used to act on the valve in a direction to open the gas lift valve 364 to receive gas from the outside of the mandrel 60 and pass it to the bore 362 for lifting production fluid to the well surface. Referring to FIGS. 15C, 18C and 16, a flow meter, such as a turbine wheel 374, is provided for measuring the volume of gas flowing through the gas lift valve 365. In addition, other instrumentation is provided connected to the mandrel 360 such as a pressure transducer 376 for measuring the pressure in the bore 362 of the mandrel 60 and thus of the production pressure. In addition, an injection pressure transducer 378 (FIG. 18C) is used to measure the pressure in the annulus or the pressure of the gas being injected. In addition, a temperature transducer 380 may also be provided which is mounted downstream of the valve 365 for measuring the temperature of the well production.

While the present invention has been described as electrically and sequentially completing an oil and/or gas well with certain types of well tools connected to the production string, the method may include fewer than the examples given and/or may include additional electrically operated equipment. For example, the equipment may include the selective landing nipple 32 (FIG. 1A), such as described in U.S. Pat. No. 4,997,043, a bottom hole production monitor such as described in U.S. Pat. No. 4,649,993, or an instrument nipple such as described in U.S. Pat. No. 4,997,043.

Figure 2A:
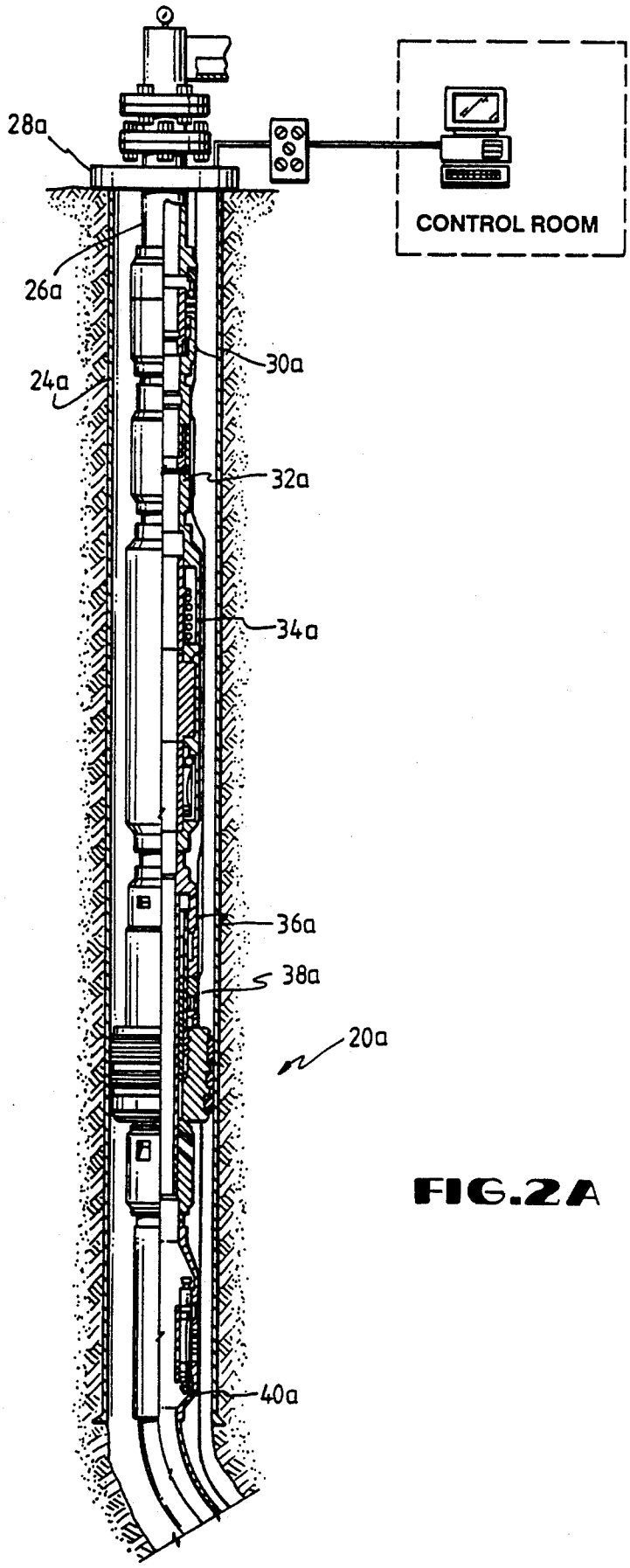
Figure 2B:
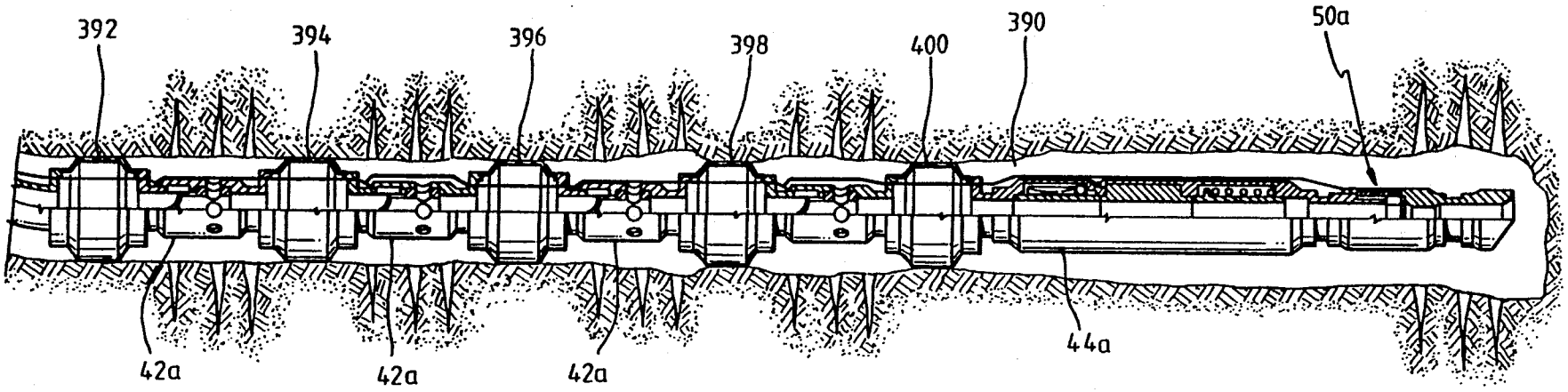

Other and further uses may be made of the present invention. Referring now to FIGS. 2A and 2B, use of the electrically operated well completion apparatus and method of the present invention is particularly useful in completing horizontal wells where because of the horizontal extension of the wells the wells cannot be easily completed by gravity fed wireline operations or coil tubing operations. Referring now to FIGS. 2A and 2B, the use of the present invention in completing a horizontally directed well is best seen wherein like parts to those illustrated in FIGS. 1A–1E are similarly numbered with the addition of the suffix "a". Starting at the top of the wellhead **28*a*, the production string 26*a* includes in sequence an electrically operated safety joint 30*a*, a landing nipple 32*a*, solenoid actuated tubing safety valve 34*a*, solenoid actuated annulus safety valve 36*a*, electrically actuated upper well packer 38*a*, and if liquid is being produced, an electrically operated gas lift system 40*a* all within the casing 24*a*. However, in the uncased portion of the well bore 390 (FIG. 2B) which may be substantially extending in a horizontal direction, one or more inflatable packers 392, 394, 396, 398 and 400 may be provided, each of them separated by an electrically operated circulating sleeve 42*a*, a solenoid actuated blocking blank valve 44*a* and an instrument nipple 50*a***.

The components with the suffix "a" are similar to the previously described components of similar numerals. The inflatable well packers 392, 394, 396, 398 and 400 may be of any conventional inflatable well packer, such as Model TamCap, sold by Tam International.

In operation, the system **20*a* of FIGS. 2A and 2B is electrically and sequentially completed by installing the tubing production string 28*a* in place with the above described connected equipment. The first step is to electrically set the top packer 38*a* similar to the setting of packer 38. Next, the blanking block valve 44*a* is closed and pressure is exerted through the wellhead 28*a* through the bore of the production tubing 26*a* to set all of the inflatable packers 392, 394, 396, 398 and 400. The tubing string 26*a* is then slacked off to allow the packer 38*a* to carry part of the hanging weight of the production string 26*a*. Thereafter, the electrically operated safety joint 30*a* is actuated similar to joint 30 to reduce the strength of the joint. Then, the annulus safety valve 36*a* is opened and the tubing safety valve 34*a* is opened. The blanking block valve 44*a* is opened, the annulus between the casing 24*a* and the production tubing 26*a* is pressurized, the gas lift system 40*a*** is energized and the annulus and tubing is unloaded. And thereafter the annulus pressure is released.

The circulating sleeves **42*a* between each of the inflatable packers are opened allowing the various well formations to flow into the production tubing 26*a***, and the well may then be brought onstream.

The present invention, therefore, is well adapted to carry out the objects and attain the ends and advantages mentioned as well as others inherent therein. While presently preferred embodiments of the invention have been given for the purpose of disclosure, numerous changes in the details of construction, arrangement of parts, and steps of the method, will readily suggest themselves to those skilled in the art and which are encompassed within the spirit of the invention and the scope of the appended claims.

What is claimed is:

1. A linear operated safety release joint for use in a well for initially supporting a production string comprising, a housing having a bore therethrough, said housing including first and second parts, one of said parts including locking dogs, and the other part including a recess for receiving said dogs for initially locking said parts together for supporting a production string, a sleeve slidable in the housing and initially holding the dogs in said recess, an electrical motor carried by the housing and connected to the sleeve for moving the sleeve away from the dogs, and shear means releasably connecting the first and second parts together, said shear means having a breaking strength less than the dogs and recess connections.

* * * * *